US006235410B1

(12) United States Patent
Komatsu et al.

(10) Patent No.: US 6,235,410 B1
(45) Date of Patent: May 22, 2001

(54) HOT-DIP ZN-AL-MG COATED STEEL SHEET EXCELLENT IN CORROSION RESISTANCE AND SURFACE APPEARANCE AND PROCESS FOR THE PRODUCTION THEREOF

(75) Inventors: Atsushi Komatsu, Izumi; Takao Tsujimura, Osaka; Kouichi Watanabe, Sakai; Nobuhiko Yamaki, Osaka-fu; Atsushi Andoh, Osaka-fu; Toshiharu Kittaka, Osaka-fu, all of (JP)

(73) Assignee: Nisshin Steel Co., Ltd., Tokyo (JP)

( * ) Notice: Subject to any disclaimer, the term of this patent is extended or adjusted under 35 U.S.C. 154(b) by 0 days.

(21) Appl. No.: 09/117,779

(22) PCT Filed: Dec. 12, 1997

(86) PCT No.: PCT/JP97/04594

§ 371 Date: Aug. 6, 1998

§ 102(e) Date: Aug. 6, 1998

(87) PCT Pub. No.: WO98/26103

PCT Pub. Date: Jun. 18, 1998

(30) Foreign Application Priority Data

| | | |
|---|---|---|
| Dec. 13, 1996 | (JP) | 8/352467 |
| Mar. 4, 1997 | (JP) | 9/063923 |
| Jun. 5, 1997 | (JP) | 9/162035 |
| Nov. 4, 1997 | (JP) | 9/316631 |

(51) Int. Cl.[7] ..... B32B 15/00; C25D 5/10

(52) U.S. Cl. ..... 428/659; 428/655; 428/659; 428/939; 420/519; 427/433; 427/435; 427/436

(58) Field of Search ..... 428/655, 659, 428/939; 420/519; 427/433, 435, 436

(56) References Cited

U.S. PATENT DOCUMENTS

| | | | | |
|---|---|---|---|---|
| 3,505,043 | * | 4/1970 | Lee et al. | 29/196.5 |
| 4,369,211 | * | 1/1983 | Nitto et al. | 427/349 |
| 5,500,290 | * | 3/1996 | Udagawa et al. | 428/610 |

FOREIGN PATENT DOCUMENTS

| | | |
|---|---|---|
| 6-158257 | 6/1994 | (JP) . |
| 8-35049 | 2/1996 | (JP) . |
| 8-60324 | 3/1996 | (JP) . |

* cited by examiner

*Primary Examiner*—Deborah Jones
*Assistant Examiner*—Lymarie Miranda
(74) *Attorney, Agent, or Firm*—McDermott, Will & Emery

(57) ABSTRACT

A hot-dip Zn—Al—Mg plated steel sheet good in corrosion resistance and surface appearance that is a hot-dip Zn-base plated steel sheet obtained by forming on a surface of a steel sheet a hot-dip Zn—Al—Mg plating layer composed of Al: 4.0–10 wt. %, Mg: 1.0–4.0 wt. % and the balance of Zn and unavoidable impurities, the plating layer having a metallic structure including a primary crystal Al phase or a primary crystal Al phase and a Zn single phase in a matrix of Al/Zn/$Zn_2Mg$ ternary eutectic structure. To obtain a plating layer possessing this metallic structure, the cooling rate of the plating layer adhering to a steel strip extracted from a plating bath and the plating bath temperature are appropriately controlled in a continuous hot-dip plating machine and/or appropriate amounts of Ti and B are added to the bath. Occurrence of a stripe pattern peculiar to this plated steel sheet is controlled by morphology control of a Mg-containing oxide film up to solidification of the plating layer or by adding an appropriate amount of Be to the plating bath.

7 Claims, 15 Drawing Sheets

(2 of 15 Drawing Sheet(s) Filed in Color)

x-ray diffraction results (Cu−Kα)

Example of plated steel sheet surface undulating curve

| No | Average elevation differention | Pitch | Steepness | Visual evaluation |
|---|---|---|---|---|
| | (μm) | (μm) | (%) | |
| 1 | 1.21 | 206612 | 0.025 | ○ |
| 2 | 5.06 | 49407 | 0.040 | ○ |
| 3 | 5.50 | 45455 | 0.048 | ○ |
| 4 | 3.63 | 68871 | 0.057 | ○ |
| 5 | 5.64 | 44326 | 0.065 | ○ |
| 6 | 4.79 | 52192 | 0.090 | ○ |
| 7 | 11.00 | 22727 | 0.101 | △ |
| 8 | 5.29 | 47259 | 0.110 | △ |
| 9 | 4.72 | 52966 | 0.121 | △ |
| 10 | 12.34 | 20259 | 0.123 | △ |
| 11 | 14.50 | 17241 | 0.133 | △ |
| 12 | 22.12 | 11302 | 0.159 | × |
| 13 | 17.44 | 14335 | 0.181 | × |
| 14 | 16.20 | 15432 | 0.194 | × |
| 15 | 12.90 | 19380 | 0.237 | × |
| 16 | 35.89 | 6966 | 0.330 | × |

HOT-DIP ZN-AL-MG COATED STEEL SHEET EXCELLENT IN CORROSION RESISTANCE AND SURFACE APPEARANCE AND PROCESS FOR THE PRODUCTION THEREOF

TECHNICAL FIELD

This invention relates to a hot-dip Zn—Al—Mg plated steel sheet good in corrosion resistance and surface appearance and a method of producing the same.

BACKGROUND ART

It is known that steel sheet immersed in a hot-dip plating bath of zinc containing an appropriate amount of Al and Mg to plate the steel sheet with this alloy exhibits excellent corrosion resistance. Because of this, various avenues of research and development have been pursued regarding this type of Zn—Al—Mg-system. Up to now, however, no case of a plated steel sheet of this system having achieved commercial success as an industrial product has been seen.

The specification of U.S. Pat. No. 3,505,043, for example, teaches a hot-dip Zn—Al—Mg plated steel sheet with excellent corrosion resistance using a hot-dip plating bath composed of Al: 3–17 wt. %, Mg: 1–5 wt. % and the remainder of Zn. This was followed by proposals set out in, for example, JPB-64-8702, JPB-64-11112 and JPA-8-60324 for improving corrosion resistance and productivity by incorporating various addition elements in the basic bath composition of this type, regulating the production conditions, and the like.

OBJECT OF THE INVENTION

In industrial production of such hot-dip Zn—Al—Mg plated steel sheet, while it is of course necessary for the obtained hot-dip plated steel sheet to have excellent corrosion resistance, it is also required to be able to produce a steel strip product good in corrosion resistance and surface appearance with good productivity. Specifically, it is necessary to be able to stably produce hot-dip Zn—Al—Mg plated steel sheet with good corrosion resistance and surface appearance by continuously passing a steel strip through an ordinary continuous hot-dip plating machine commonly used to produce hot-dip galvanized steel sheet, hot-dip aluminum plated sheet and the like. In this specification, the term "hot-dip Zn—Al—Mg plated steel sheet" is for convenience used also for a hot-dip Zn—Al—Mg plated steel strip produced by passing a steel strip through a continuous hot-dip plating machine. In other words, "plated sheet" and "plated strip" are defined as representing the same thing.

In the equilibrium phase diagram for Zn—Al—Mg, the ternary eutectic point at which the melting point is lowest (melting point=343° C.) is found in the vicinity of Al of about 4 wt. % and Mg in the vicinity of about 3 wt. %. In the production of hot-dip Zn—Al—Mg plated steel sheet based on a Zn—Al—Mg ternary alloy, therefore, it would appear at a glance to be advantageous to make the composition close to this ternary eutectic point.

When a bath composition in the vicinity of this ternary eutectic point is adopted, however, a phenomenon arises of local crystallization of a $Zn_{11}Mg_2$-system phase in the metal structure of the plating, actually of an $Al/Zn/Zn_{11}Mg_2$ ternary eutectic crystal matrix per se or in this matrix of a $Zn_{11}Mg_2$-system phase including a primary crystal Al phase or a primary crystal Al phase and an Zn single phase. This locally crystallized $Zn_{11}Mg_2$-system phase discolors more easily than the other phase ($Zn_2Mg$-system phase). During standing, this portion assumes a highly conspicuous color tone and markedly degrades the surface appearance. The value of the plated steel sheet as a product is therefore manifestly degraded.

Through their experience, moreover, the inventors learned that when this $Zn_{11}Mg_2$-system phase locally crystallizes there arises a phenomenon of this crystallized portion being preferentially corroded.

An object of the invention is therefore to overcome this problem and to provide a hot-dip Zn—Al—Mg plated steel sheet good in corrosion resistance and surface appearance.

The inventors further learned that when the ordinary hot-dip plating operation of continuously immersing/extracting a steel strip in/from a bath is applied to a plating bath of this system, a stripe pattern of lines running in the widthwise direction of the sheet occurs. During production of Zn-base plated steel sheet containing no Mg, no such line-like stripe pattern occurs under normal conditions even if Al should be added to the bath, nor have cases of its occurrence been noted in hot-dip Al plated steel sheet. The inventors discovered that the Mg in the bath is involved in the cause, specifically that the stripe pattern of lines occurring at intervals in the widthwise direction of the steel sheet is peculiar to hot-dip galvanized steel sheet containing Mg.

The inventors believe the reason for this to be that a Mg-containing oxide film forms on the surface of the molten plating layer adhering to the steel strip immediately after extraction from the bath and that owing to this formation the surface tension and viscosity of the plating layer surface portion are of a special nature not found in hot-dip galvanized steel sheet, hot-dip Al plated steel sheet and the like. Overcoming the problem of this special nature is indispensable for industrial production of such plated steel.

One object of the invention is therefore to provide such steel sheet having a good appearance without such a pattern.

DISCLOSURE OF THE INVENTION

This invention provides a hot-dip Zn—Al—Mg plated steel sheet good in corrosion resistance and surface appearance that is a hot-dip Zn-base plated steel sheet obtained by forming on a surface of a steel sheet a hot-dip Zn—Al—Mg plating layer composed of Al: 4.0–10 wt. %, Mg: 1.0–4.0 wt. % and the balance of Zn and unavoidable impurities, the plating layer having a metallic structure including a primary crystal Al phase or a primary crystal Al phase and a Zn single phase in a matrix of $Al/Zn/Zn_2Mg$ ternary eutectic structure.

In the metallic structure of the plating layer, preferably the total amount of the primary crystal Al phase and the $Al/Zn/Zn_2Mg$ ternary eutectic structure is not less than 80 vol. % and the Zn single phase is not greater than 15 vol. % (including 0 vol. %.

The hot-dip plated steel sheet having the plating layer of this metallic structure can be produced by, in the course of producing a hot-dip Zn—Al—Mg plated steel sheet using a hot-dip plating bath composed of Al: 4.0–10 wt. %, Mg: 1.0–4.0 wt. % and the balance of Zn and unavoidable impurities, controlling the bath temperature of the plating bath to not lower than the melting point and not higher than 450° C. and the cooling rate up to completion of plating layer solidification to not less than 10° C./s or controlling the bath temperature of the plating bath to not lower than 470° C. and the post-plating cooling rate up to completion of plating layer solidification to not less than 0.5° C./s.

The invention further provides a hot-dip Zn—Al—Mg-system plated steel sheet good in corrosion resistance and surface appearance that is a hot-dip Zn-base plated steel sheet obtained by forming on a surface of a steel sheet a plating layer composed of Al: 4.0–10 wt. %, Mg: 1.0–4.0 wt. %, Ti: 0.002–0.1 wt. %, B: 0.001–0.045 wt. % and the balance of Zn and unavoidable impurities, the plating layer having a metallic structure including a primary crystal Al phase or a primary crystal Al phase and a Zn single phase in a matrix of Al/Zn/$Zn_2Mg$ ternary eutectic structure. In the metallic structure of this Ti/B-added plating layer, preferably the total amount of the primary crystal Al phase and the Al/Zn/$Zn_2Mg$ ternary eutectic structure is not less than 80 vol. % and the Zn single phase is not greater than 15 vol. % (including 0 vol. %.

In the case of this Ti/B-added hot-dip Zn—Al—Mg plated steel sheet, a hot-dip plated steel sheet having a metallic structure including a primary crystal Al phase or a primary crystal Al phase and a Zn single phase in a matrix of Al/Zn/$Zn_2Mg$ ternary eutectic structure can be produced by using a hot-dip plating bath composed of Al: 4.0–10 wt. %, Mg: 1.0–4.0 wt. %, Ti: 0.002–0.1 wt. %, B: 0.001–0.045 wt. % and the balance of Zn and unavoidable impurities and controlling the bath temperature of the plating bath to not lower than the melting point and lower than 410° C. and the post-plating cooling rate to not less than 7° C./s or controlling the bath temperature of the plating bath to not lower than 410° C. and the post-plating cooling rate to not less than 0.5° C./s.

According to the invention, in order to control the stripe pattern of lines running in the widthwise direction of the sheet that readily arises in a Zn—Al—Mg plated steel sheet of this type, it was found advantageous to subject the Mg-containing oxide film that forms on the surface layer of the molten plating layer adhering to the surface of the steel strip continuously extracted from the bath to morphology control until the plating layer has solidified, more explicitly, to regulate the oxygen concentration of the wiping gas to not greater than 3 vol. % or to provide a sealed box to isolate the steel sheet extracted from the bath from the atmosphere and make the oxygen concentration in the sealed box not greater than 8 vol. %.

Further, according to the invention, it was found that occurrence of the stripe pattern of lines in the widthwise direction of the sheet can be controlled by adding to the plating bath an appropriate amount of Be, specifically, 0.001–0.05% of Be. The invention therefore also provides a hot-dip Zn-base plated steel sheet with no stripe pattern produced using a hot-dip plating bath obtained by adding Be: 0.001–0.05 wt. % to a hot-dip Zn—Al—Mg-system plating bath composed of Al: 4.0–10 wt. % and Mg: 1.0–4.0 wt. %, and, as required, Ti: 0.002–0.1 wt. % and B: 0.001–0.045 wt. %, and the balance of Zn and unavoidable impurities.

BRIEF DESCRIPTION OF DRAWINGS

The file of this patent contains at least one drawing execited in color. Copies of this patent with color drawings will be provided by the Patent and Trademark Office upon request and payment of the necessary fee.

PREFERRED MODES OF THE INVENTION

The hot-dip Zn—Al—Mg plated steel sheet according to the invention is hot-dip plated using a hot-dip plating bath composed of Al: 4.0–10 wt. %, Mg: 1.0–4.0 wt. % and the balance of Zn and unavoidable impurities. The plating layer obtained has substantially the same composition as the plating bath. However, the structure of the plating layer is characterized in that it is made into a metallic structure including a primary crystal Al phase in a matrix of Al/Zn/$Zn_2Mg$ ternary eutectic structure or that it is made into a metallic structure including a primary crystal Al phase and a Zn phase in said matrix. By this, it simultaneously improves corrosion resistance, surface appearance and productivity.

Figure 2:
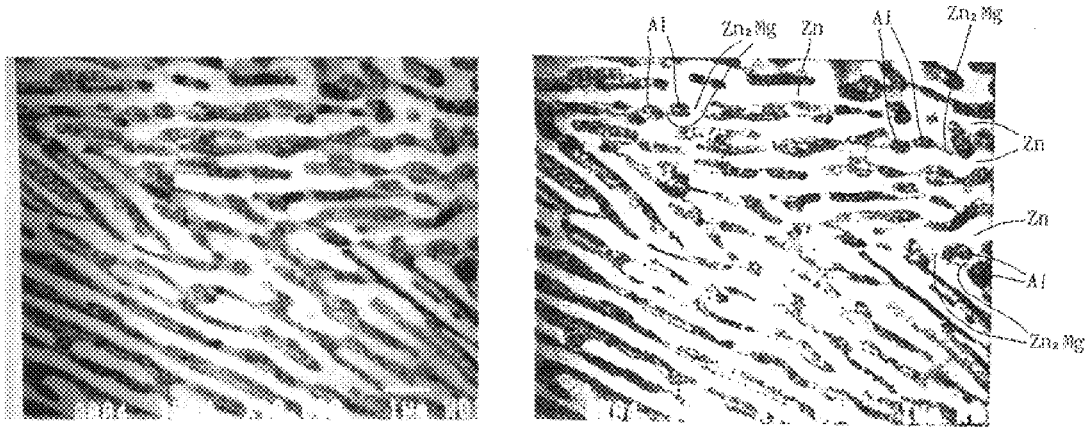
FIG. 2 is an electron microscope secondary-electron micrograph and a diagram for explaining the micrograph, showing an enlargement of the Al/Zn/$Zn_2Mg$ ternary eutectic structure matrix portion of the metallic structure of FIG. 1.

The Al/Zn/$Zn_2Mg$ ternary eutectic structure here is a ternary eutectic structure including an Al phase, a Zn phase and an intermetallic compound $Zn_2Mg$ phase, as shown for example by the typical example in the electron microscope secondary-electron micrograph of FIG. 2. The Al phase forming this ternary eutectic structure actually originates from an "Al" phase" (Al solid solution with Zn present in solid solution and containing a small amount of Mg) at high temperature in the Al—Zn—Mg ternary system equilibrium phase diagram. This Al" phase at high temperature ordinarily manifests itself at normal room temperature as divided into a fine Al phase and a fine Zn phase. Moreover, the Zn phase of the ternary eutectic structure is a Zn solid solution containing a small amount of Al in solid solution and, in some cases, a small amount of Mg in solid solution. The $Zn_2Mg$ phase of the ternary eutectic structure is an intermetallic compound phase present in the vicinity of Zn: approx. 84 wt. % in the Zn—Mg binary equilibrium phase diagram. In this specification, the ternary eutectic structure composed of these three phases is represented as Al/Zn/$Zn_2Mg$ ternary eutectic structure.

Figure 1:
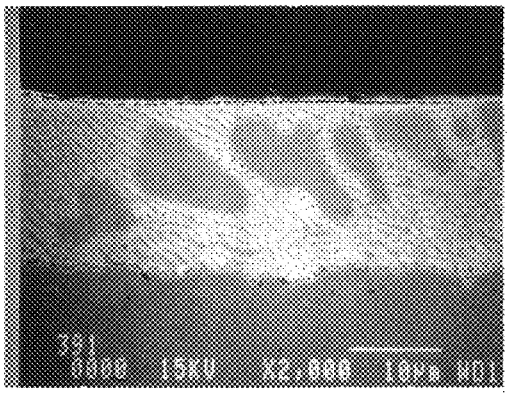
FIG. 1 is an electron microscope secondary-electron micrograph and a diagram for explaining the micrograph, showing the cross-sectional metallic structure of the plating layer of a hot-dip Zn—Al—Mg plated steel sheet according to the invention.
Figure 1:
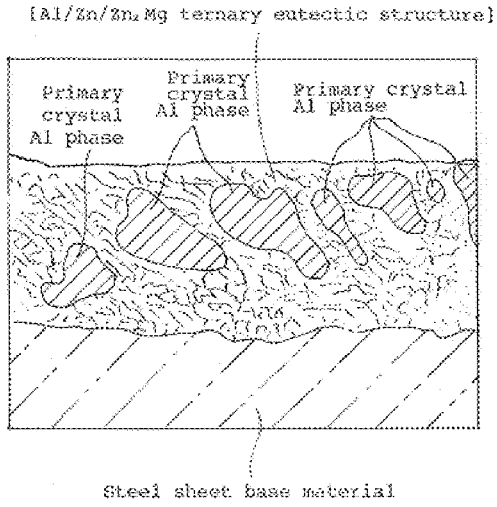

As shown for example by the typical example in the electron microscope secondary-electron micrograph of FIG. 1, the primary crystal Al phase appears as islands with sharply defined boundaries in the ternary eutectic structure matrix and originates from an "Al" phase" (Al solid solution with Zn present in solid solution and containing a small amount of Mg) at high temperature in the Al—Zn—Mg ternary system equilibrium phase diagram. The amount of Zn and the amount of Mg present in solid solution in the Al" phase at high temperature differs depending on the plating bath composition and/or the cooling conditions. At normal room temperature, this Al" phase at high temperature ordinarily divides into a fine Al phase and a fine Zn phase. In fact, when this portion is observed further microscopically, a structure of finely precipitated Zn can be seen but the island-like configurations appearing with sharply defined boundaries in the ternary eutectic structure matrix can be viewed as retaining the skeletal form of the Al" phase at high temperature. The phase originating from this Al" phase at high temperature (called Al primary crystal) and shape-wise substantially retaining the skeletal form of the Al" phase is referred to as primary crystal Al phase in this specification. This primary crystal Al phase can be clearly distinguished from the Al phase of the ternary eutectic structure by microscopic observation.

Figure 3:
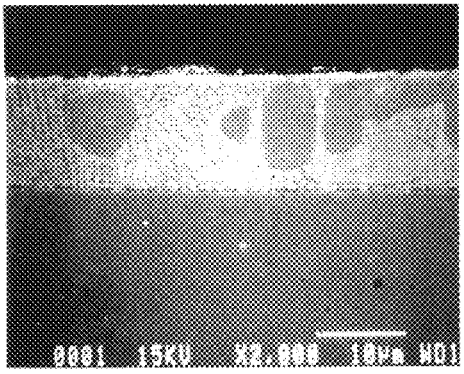
FIG. 3 is an electron microscope secondary-electron micrograph and a diagram for explaining the micrograph, showing the cross-sectional metallic structure of the plating layer of a hot-dip Zn—Al—Mg plated steel sheet according to the invention (the same structure as that in FIG. 1 except for the inclusion of Zn single phase).
Figure 3:
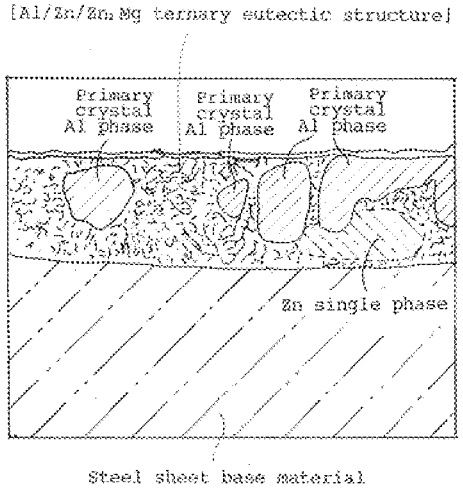

As shown for example by the typical example in the electron microscope secondary-electron micrograph of FIG. 3, the Zn single phase appears as islands with sharply defined boundaries in the ternary eutectic structure matrix (and appears somewhat whiter than the primary crystal Al phase). In actuality, it may have a small amount of Al and, further, a small amount of Mg present therein in solid solution. This Zn single phase can be clearly distinguished from the Zn phase of the ternary eutectic structure by microscopic observation.

In this specification, the metallic structure including a primary crystal Al phase or a primary crystal Al phase and a Zn single phase in the Al/Zn/$Zn_2Mg$ ternary eutectic structure is sometimes called a "$Zn_2Mg$-system phase". Moreover, what is referred to in this specification as a "$Zn_{11}Mg_2$-system phase" indicates both the metallic structure of the Al/Zn/$Zn_{11}Mg_2$ ternary eutectic structure matrix itself and the metallic structure of this matrix including the primary crystal Al phase or primary crystal Al phase and Zn single phase. When the latter $Zn_{11}Mg_2$-system phase manifests itself in spots of visible size, the surface appearance is markedly degraded and corrosion resistance decreases. The plating layer according to the invention is characterized in the point that substantially no spot-like $Zn_{11}Mg_2$-system phase of visible size is present.

The hot-dip Zn—Al—Mg plated steel sheet according to this invention is thus characterized in the point of having a specific metallic structure. The explanation will begin from the basic plating composition of the plated steel sheet.

The Al in the plating layer works to improve the corrosion resistance of the plated steel sheet and the Al in the plating bath works to suppress generation of a dross composed of Mg-containing oxide film on the surface of the plating bath. At an Al content of less than 4.0 wt. %, the effect of improving the corrosion resistance of the steel sheet is insufficient and the effect of suppressing generation of the dross composed of Mg-containing oxide is also low. On the other hand, when the Al content exceeds 10 wt. %, growth of an Fe—Al alloy layer at the interface between the plating layer and the steel sheet base material becomes pronounced to degrade the plating adherence. The preferred Al content is 4.0–9.0 wt. %, the more preferable Al content is 5.0–8.5 wt. %, and the still more preferable Al content is 5.0–7.0 wt. %

The Mg in the plating layer works to generate a uniform corrosion product on the plating layer surface to markedly enhance the corrosion resistance of the plated steel sheet. At a Mg content of less than 1.0%, the effect of uniform generation of the corrosion product is insufficient, while when the Mg content exceeds 4.0%, the effect of corrosion resistance by Mg saturates and, disadvantageously, the dross composed of Mg-containing oxide generates more readily on the plating bath. The Mg content is therefore made 1.0–4.0%. The preferred Mg content is 1.5–4.0 wt. %, the more preferable Mg content is 2.0–3.5 wt. %, and the still more preferable Mg content is 2.5–3.5 wt. %.

As was pointed out earlier, it was found that when a $Zn_{11}Mg_2$-system phase crystallizes in a Zn—Al—Mg ternary composition containing such amounts of Al and Mg in Zn, the surface appearance is degraded and the corrosion resistance is also degraded. In contrast, it was found that when the structure of the plating layer is made a metallic structure including a primary crystal Al phase or a primary crystal Al phase and a Zn single phase in an Al/Zn/$Zn_2Mg$ ternary eutectic structure, the surface appearance is outstandingly good and the corrosion resistance superior.

The structure of a primary crystal Al phase included in an Al/Zn/$Zn_2Mg$ ternary eutectic structure matrix here is a metallic structure of first-precipitated primary crystal Al phase included in an Al/Zn/$Zn_2Mg$ ternary eutectic structure matrix, when the plating layer cross-section is observed microscopically.

FIG. 1 is an electron microscope secondary-electron micrograph (2,000 magnifications) of a cross-section showing a metallic structure typical of this type. The composition of the plating layer hot-dip plated on the surface of the lower steel sheet base material steel (the somewhat blackish portion) is 6Al-3Mg—Zn (approx. 6 wt. % Al, approx. 3 wt. % Mg, balance Zn). On the right is a diagram analyzing the phases of the structure by sketching the structure of the photograph in FIG. 1. As shown in this diagram, primary crystal Al phase is included in the Al/Zn/$Zn_2Mg$ ternary eutectic structure matrix in the state of discrete islands.

FIG. 2 is an electron microscope secondary-electron micrograph showing an enlargement of the matrix portion of the Al/Zn/$Zn_2Mg$ ternary eutectic structure in FIG. 1 (10,000 magnifications). As shown in the analytical sketch on the right, the matrix has a ternary eutectic structure composed of Zn (white portions), Al (blackish, grain-like portions) and $Zn_2Mg$ (rod-like portions constituting the remainder).

The structure of a primary crystal Al phase and a Zn single phase included in an Al/Zn/$Zn_2Mg$ ternary eutectic structure matrix is a metallic structure of primary crystal Al phase and Zn single phase included in an Al/Zn/$Zn_2Mg$ ternary eutectic structure matrix, when the plating layer cross-section is observed microscopically. In other words, aside from the crystallization of a small amount of Zn single phase, it is no different from the former metallic structure. Despite this crystallization of a small amount of Zn single phase, the corrosion resistance and appearance are substantially as good as those of the former structure.

FIG. 3 is an electron microscope secondary-electron micrograph (2,000 magnifications) of a cross-section showing a metallic structure typical of this type. The composition of the plating layer is 6Al-3Mg—Zn (approx. 6 wt. % Al, approx. 3wt. % Mg, balance Zn). As can be seen in FIG. 3, the structure is the same as that of FIG. 1 in the point of having discrete islands of (primary crystal Al phase included in the Al/Zn/$Zn_2Mg$ ternary eutectic structure matrix but further has discrete Zn single phase islands (gray portion somewhat lighter in color than the primary crystal Al phase).

Figure 4:
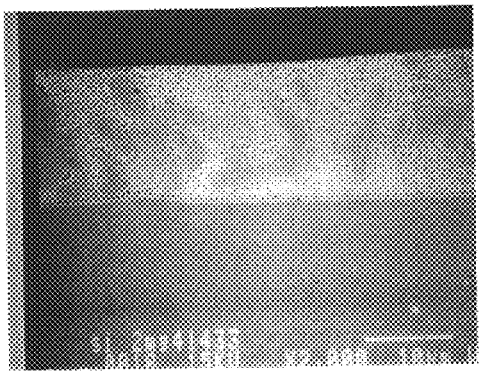
FIG. 4 is an electron microscope secondary-electron micrograph and a diagram for explaining the micrograph, showing the cross-sectional metallic structure of the plating layer of a hot-dip Zn—Al—Mg plated steel sheet according to the invention (the same structure as that in FIG. 1 except for the inclusion of Zn single phase; the primary crystal Al structure being finer than in FIG. 3).
Figure 4:
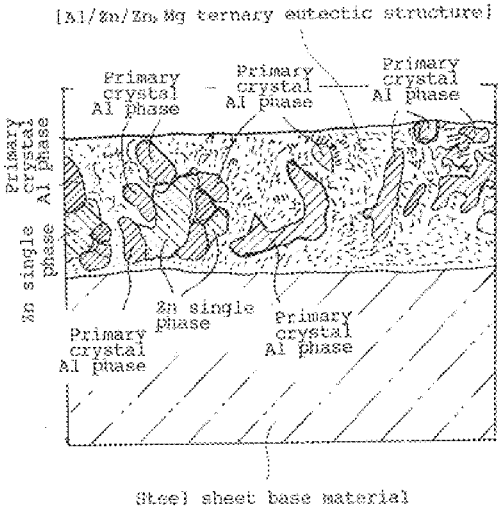

FIG. 4 is an electron microscope secondary-electron micrograph (2,000 magnifications) of a cross-section of a plating layer of the structure obtained when the post-hot-dip plating cooling rate of the same plating composition as that of FIG. 3 was made faster than that of FIG. 3. In the structure of FIG. 4, the primary crystal Al phase is a little finer than that in FIG. 3 and Zn single phase is present in the vicinity thereof. There is, however, no difference in the point that primary crystal Al phase and Zn single phase are included in an Al/Zn/$Zn_2Mg$ ternary eutectic structure matrix.

Regarding the percentage of the whole layer accounted for by these structures, in the former case, i.e., in the metallic structure having first-precipitated primary crystal Al phase scattered within an Al/Zn/$Zn_2Mg$ ternary eutectic structure matrix, the total amount of Al/Zn/$Zn_2Mg$ ternary eutectic structure+primary crystal Al phase is not less than 80 vol. %, preferably not less than 90 vol. %, and still more preferably not less than 95 vol. %. The remainder may include a small amount of Zn/$Zn_2Mg$ binary eutectic or $Zn_2Mg$.

In the latter, i.e., in the metallic structure having scattered primary crystal Al phase and also Zn single phase crystallized within an Al/Zn/$Zn_2Mg$ ternary eutectic structure matrix, the total amount of Al/Zn/$Zn_2Mg$ ternary eutectic structure+primary crystal Al phase is not less than 80 vol. % and the amount of Zn single phase is not more than 15 vol. %. The remainder may include a small amount of Zn/$Zn_2Mg$ binary eutectic or $Zn_2Mg$.

Preferably, the structures of both the former and latter are substantially absent of $Zn_{11}Mg_2$-system phase. It was found that in the composition range according to the invention, the $Zn_{11}Mg_2$-system phase is likely to appear "spotwise" as a phase of the metallic structure including Al primary crystal or Al primary crystal and Zn single phase in an Al/Zn/$Zn_{11}Mg_2$ ternary eutectic structure matrix.

Figure 5:
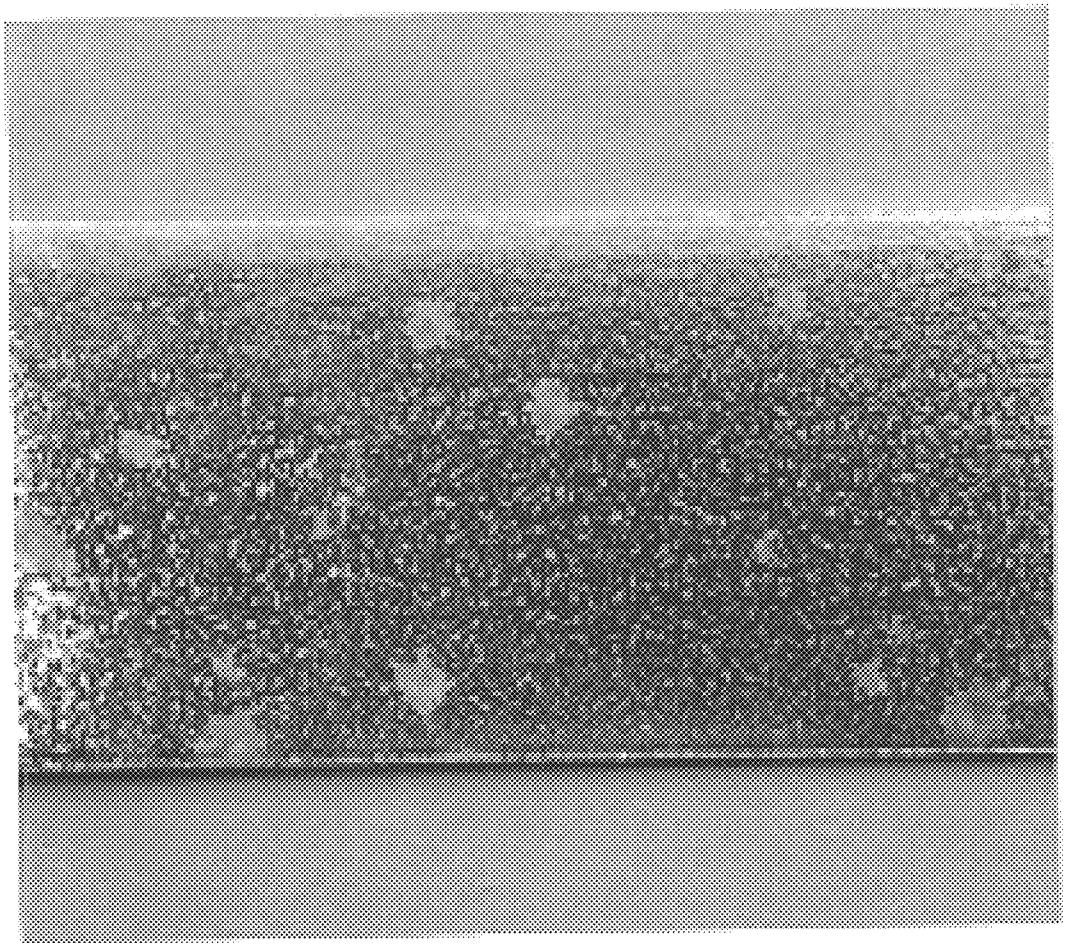
FIG. 5 is a photograph taken of the surface of a hot-dip Zn—Al—Mg plated steel sheet at which scattered $Zn_{11}Mg_2$-system phase spots of visible size have appeared.

FIG. 5 is a photograph taken of the surface appearance of a plated steel sheet (that of No. 13 in Table 3 of Example 3 set out later) wherein $Zn_{11}Mg_2$-system phase has appeared spotwise. As can be seen in FIG. 5, spots of about 2–7 mm radius (portions discolored blue) are visible at scattered points in the matrix phase. The size of these spots differs depending on the bath temperature and the cooling rate of the hot-dip plating layer.

Figure 6:
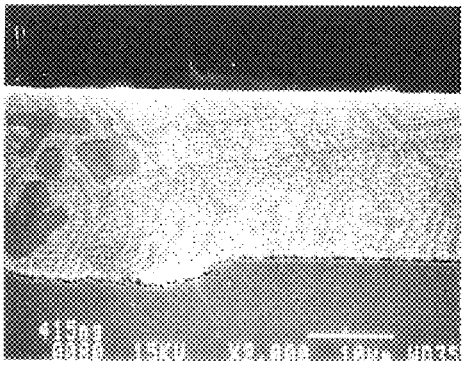
FIG. 6 shows electron microscope secondary-electron micrographs (2,000 magnifications) of a section cut through a spot portion in FIG. 5.
Figure 6:
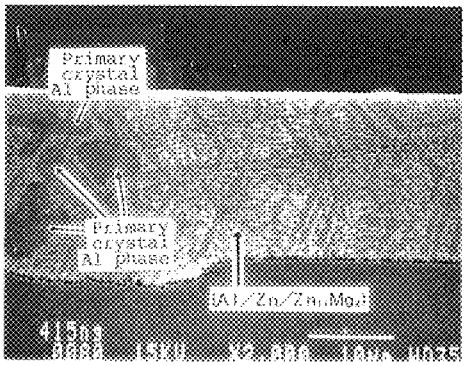

FIG. 6 shows electron microscope secondary-electron micrographs (2,000 magnifications) of a section cut through a sample so as to pass through a spot portion in FIG. 5. As can be seen in FIG. 6, the structure of the spot portion is that of Al primary crystal included in an Al/Zn/$Zn_{11}Mg_2$ ternary eutectic structure matrix. (Depending on the sample, Al primary crystal and Zn single phase may be included in the matrix.)

Figure 7:
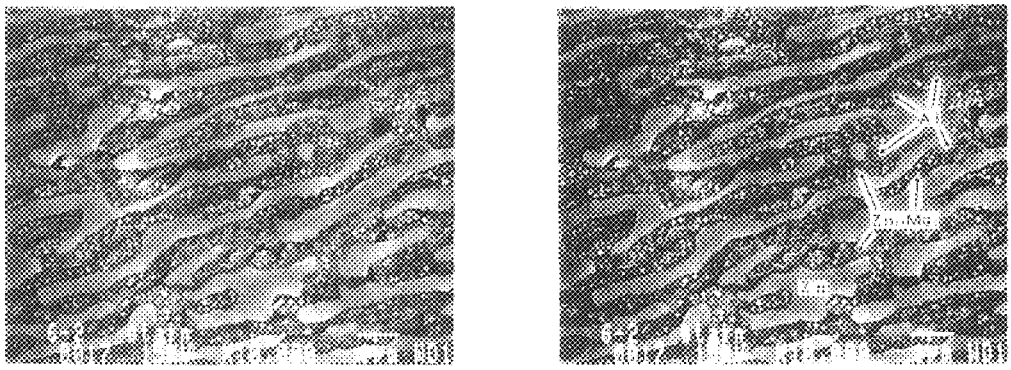
FIG. 7 shows electron microscope secondary-electron micrographs (10,000 magnifications) magnifying the ternary eutectic portion of the structure of FIG. 6.

FIG. 7 shows electron microscope secondary-electron micrographs of only the matrix portion of FIG. 6 (portion containing no Al primary crystal) at a higher magnification (10,000 magnifications). Between the whitish Zn stripes are clearly visible ternary eutectic structures including $Zn_{11}Mg_2$ and Al (somewhat blackish, grain-like portions), i.e., Al/Zn/$Zn_{11}Mg_2$ ternary eutectic structures.

Figure 8:
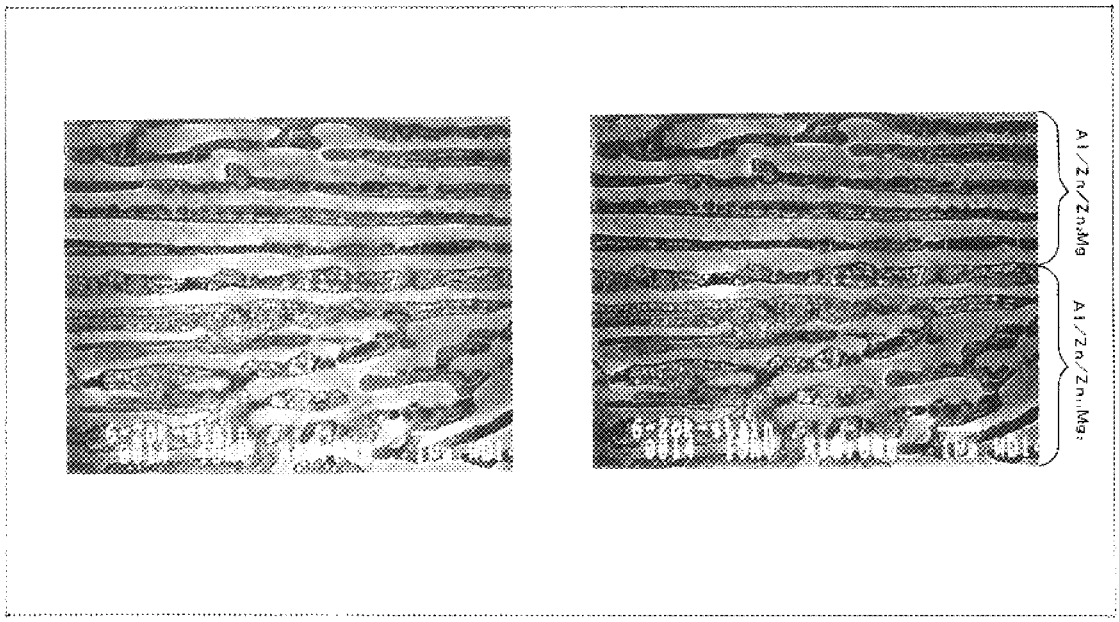
FIG. 8 shows electron microscope secondary-electron micrographs (10,000 magnifications) of a boundary portion of a spot in FIG. 5, the upper half being the $Zn_2Mg$-system phase matrix portion and the lower half being the $Zn_{11}Mg_2$-system matrix portion of the spot portion.

FIG. 8 shows electron microscope secondary-electron micrographs (10,000 magnifications) relating to a spot portion such as seen in FIG. 5, showing a boundary portion between the matrix phase and the spot phase. In the photograph of FIG. 8, the upper half is the matrix phase portion and the lower half is the spot phase. The matrix phase portion of the upper half is the same Al/Zn/$Zn_2Mg$ ternary eutectic structure as that of FIG. 2 and the lower half shows the same Al/Zn/$Zn_{11}Mg_2$ ternary eutectic structure as in FIG. 7.

From FIGS. 5 to 8, it can be seen that the spot-like $Zn_{11}Mg_2$-system phase is actually one having a metallic structure of Al primary crystal or Al primary crystal and Zn single phase included in an Al/Zn/$Zn_{11}Mg_2$ ternary eutectic structure matrix and that the $Zn_{11}Mg_2$-system phase appears as scattered spots of visible size in the matrix of the $Zn_2Mg$-system phase, i.e., in the matrix of a metallic structure having primary crystal Al phase or primary crystal Al phase and Zn single phase included in an Al/Zn/$Zn_2Mg$ ternary eutectic structure matrix.

Figure 9:
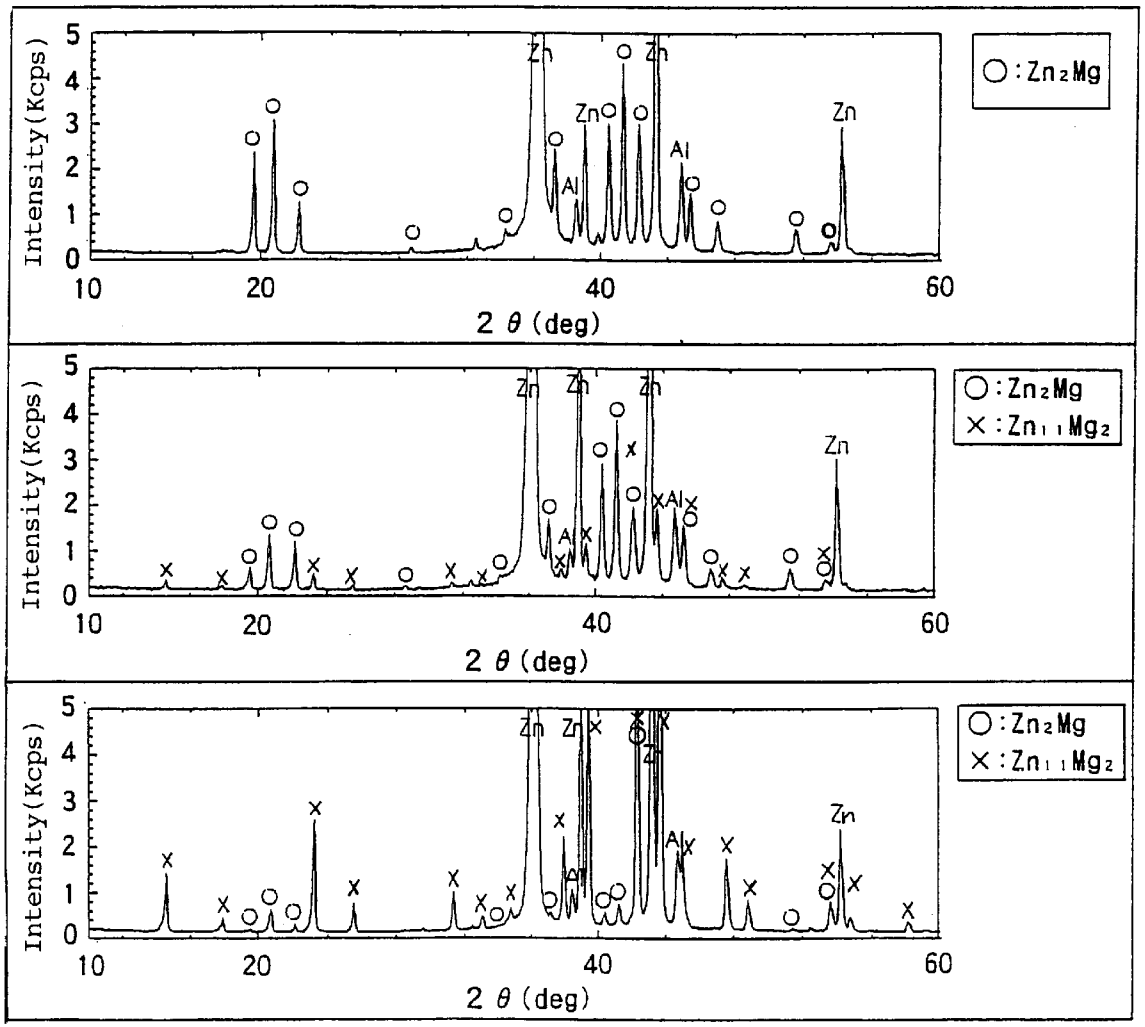
FIG. 9 shows x-ray diffraction charts obtained for 17 mm×17 mm samples taken from the No. 3 and No. 14 plated steel sheets in Table 3 of Example 3, the top chart in FIG. 9 relating to No. 3 and the middle and bottom ones relating to the No. 14 sample, which was taken so as to include a $Zn_{11}Mg_2$-system phase spot as part of the sample area.

FIG. 9 shows examples of x-ray diffraction typical of those providing the basis for identifying the aforesaid metallic structures. In the drawing, the peaks marked ○ are those of the $Zn_2Mg$ intermetallic compound and the peaks marked X are those of the $Zn_{11}Mg_2$ intermetallic compound. Each of the x-ray diffractions was conducted by taking a 17 mm×17 mm square plating layer sample and exposing the surface of the square sample to x-rays under conditions of a Cu—Kα tube, a tube voltage of 150 Kv, and a tube current of 40 mA.

The top chart in FIG. 9 relates to No. 3 in Table 3 of Example 3 and the middle and bottom charts to the No. 14 in the same Table 3. The samples of the middle and bottom charts were taken so as to include a $Zn_{11}Mg_2$-system phase spot as part of the sample area. The ratio of the spot area within the sampled area was visually observed to be about 15% in the middle chart and about 70% in the bottom chart. From these x-ray diffractions, it is clear that the ternary eutectic structure seen in FIG. 2 is Al/Zn/$Zn_2Mg$ ternary eutectic structure and that the ternary eutectic structure seen in FIG. 7 is Al/Zn/$Zn_{11}Mg_2$.

From this metallic-structural viewpoint, in Tables 3, 5 and 6 of Examples set out later and also in FIG. 10 described later, plating layers according to the invention that have substantially no $Zn_{11}Mg_2$-system phase are represented as "$Zn_2Mg$" and those in which $Zn_{11}Mg_2$-system phase appears in spots of visible size in a $Zn_2Mg$-system phase matrix are represented as "$Zn_2Mg+Zn_{11}Mg_2$." When such spot-like $Zn_{11}Mg_2$-system phase appears, corrosion resistance is degraded and surface appearance is markedly diminished. The plating layer according to the invention is therefore preferably composed of a metallic structure having substantially no $Zn_{11}Mg_2$-system phase of visibly observable size, i.e., substantially of $Zn_2Mg$-system phase.

More specifically, in the plating layer of the hot-dip Zn—Al—Mg plated steel sheet having a composition within the aforesaid range according to the invention, $Al/Zn/Zn_2Mg$ ternary eutectic structure matrix is present in the range of 50 to less than 100 vol. %, island-like primary crystal Al phase is present in this eutectic structure matrix in the range of more than 0 to 50 vol. %, and, in some cases, island-like Zn single phase is further present therein at 0–15 vol. %. When the surface of the plating layer is observed with the naked eye, $Zn_{11}Mg_2$-system phase (phase having $Al/Zn/Zn_{11}Mg_2$ ternary eutectic structure matrix) that appears in spots is not present in visible size. In other words, the metallic structure of the plating layer is substantially composed of $Al/Zn/Zn_2Mg$ ternary eutectic structure matrix: 50 to less than 100 vol. %, primary crystal Al phase: more than 0 to 50 vol. %, and Zn single phase: 0–15 vol. %.

"Substantially composed" here means that other phases, typically spot-like $Zn_{11}Mg_2$-system phase, are not present in amounts that affect appearance and that even if $Zn_{11}Mg_2$-system phase is present in such a small amount that it cannot be distinguished by visual observation, such small amount can be tolerated so long as it does not have an effect on corrosion resistance and surface appearance. In other words, since $Zn_{11}Mg_2$-system phase has an adverse effect on appearance and corrosion resistance when present in such amount as to be observable in spots with the naked eye, such amount falls outside the range of the invention. Moreover, presence of $Zn_2Mg$-system binary eutectic, $Zn_{11}Mg_2$-system binary eutectic and the like is also tolerable in small amounts that cannot be distinguished by visual observation with the naked eye.

Figure 10:
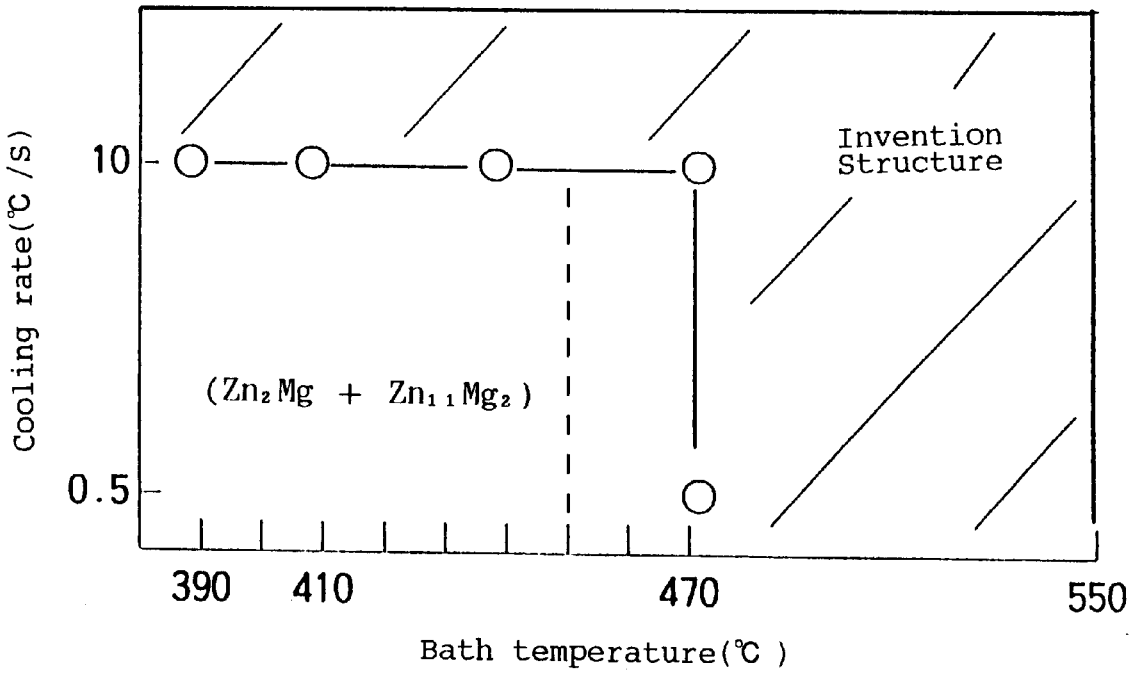
FIG. 10 is a diagram showing the range of conditions advantageous for production the hot-dip Zn—Al—Mg plated steel sheet of the invention.

To produce the hot-dip Zn—Al—Mg plated steel sheet of the metallic structure according to the invention it was found sufficient to control the bath temperature of the hot-dip plating bath of the foregoing composition and the post-plating cooling rate typically within the range of the hatching shown in FIG. 10.

Specifically, as can be seen in FIG. 10, and as indicated in Examples set out later, when the bath temperature is lower than 470° C. and the cooling rate is less than 10° C./s, the aforesaid $Zn_{11}Mg_2$-system phase appears in spots, making it impossible to achieve the object of the invention. That such a $Zn_{11}Mg_2$-system phase appears itself can be understood to some degree by looking at the equilibrium phase in the vicinity of the ternary eutectic point in the Zn—Al—Mg equilibrium phase diagram.

It was found, however, that when the bath temperature exceeds 450° C., more preferably rises to 470° C. or higher, the effect of the cooling rate diminishes and the $Zn_{11}Mg_2$-system phase does not appear, whereby the metallic structure defined by the invention can be obtained. It was similarly found that even at a bath temperature of 450° C. or lower, more preferably even at one of 470° C. or lower, the metallic structure defined by the invention can be obtained if the cooling rate is made not less than 10° C./s, more preferably not less than 12° C./s. This is a structure state that cannot be predicted from the Zn—Al—Mg equilibrium phase diagram and a phenomenon that cannot be explained by equilibrium theory.

When this phenomenon is utilized, a hot-dip Zn—Al—Mg plated steel sheet that has a plating layer of the aforesaid metallic structure according to the invention and is good in corrosion resistance and surface appearance can be industrially produced by, in a continuous hot-dip plating machine, conducting hot-dip plating of the steel sheet surface using a hot-dip plating bath composed of Al: 4.0–10 wt. %, Mg: 1.0–4.0 wt. % and the balance of Zn and unavoidable impurities, controlling the bath temperature of the plating bath to not lower than the melting point and not higher than 450° C., preferably lower than 470° C., and the post-plating cooling rate to not less than 10° C./s, preferably not less than 12° C., or conducting hot-dip plating of the steel sheet surface with the bath temperature of the plating bath set not lower than 470° C. and the post-plating cooling rate arbitrarily set (to not less than 0.5° C./s, the lower limit value in an actual practical operation).

Of note is that while it has been considered advantageous to bring the bath composition into perfect agreement with the ternary eutectic composition (Al=4 wt. %, Mg=3 wt. % and Zn=93 wt. % in the equilibrium phase diagram) so as to minimize the melting point, this in actuality leads to shrinkage of the finally solidifying portions that results in a rough surface state of bad appearance. A perfect ternary eutectic composition is therefore advisably avoided. As regards the Al content, moreover, it is preferable to adopt a content on the hypereutectic side within the aforesaid composition range since $Zn_{11}Mg_2$ crystallizes out still more readily at a composition on the hypoeutectic side.

Regarding the bath temperature, with the bath composition of the invention, it is preferable, as indicated in Examples set out later, to set 550° C. as the upper limit of the bath temperature and to effect the hot-dip plating at a bath temperature not higher than this, because the plating adhesion is degraded when the bath temperature is too high.

As pointed out earlier, within the bath composition range defined by the invention, the bath temperature and the post-plating cooling rate greatly influence the generation/nongeneration behavior of $Zn_{11}Mg_2$ and $Zn_2Mg$ as ternary eutectics. Although the reason for this is still not completely clear, it is thought to be approximately as follows.

Since the rate of $Zn_{11}Mg_2$ crystallization decreases with increasing bath temperature to become nil at and above 470° C., the bath temperature can be viewed as being directly related to generation of $Zn_{11}Mg_2$ phase nuclei. Although a definitive reason cannot be given for this, the physical properties of the reaction layer (alloy layer) between the plating layer and the steel sheet are presumed to be involved. This is because the alloy layer is thought to be the main solidification starting point of the plating layer.

As the post-plating cooling rate becomes more rapid, moreover, the size of the spot-like $Zn_{11}Mg_2$ phase, i.e., the spot-like phase including Al primary crystal or Al primary crystal and Zn single phase in an $Al/Zn/Zn_{11}Mg_2$ ternary eutectic structure, gradually decreases to the point of becoming difficult to observe visually. Then eventually at a cooling rate of 10° C./s or higher, the size diminishes to the point of becoming indistinguishable by visual observation. In other words, it is considered that growth of the $Zn_{11}Mg_2$-system phase is impeded with increasing cooling rate.

The inventors newly learned that generation and growth of such a $Zn_{11}Mg_2$-system phase can be further controlled by using a plating bath obtained by adding appropriate amounts of Ti and B to the bath of the aforesaid basic composition. According to this knowledge, even if the control ranges of the bath temperature and the cooling rate are broadened relative to those in the case of no Ti/Bi addition, a $Zn_2Mg$-system phase, i.e., a plating layer having a metallic structure of primary crystal Al phase or primary crystal Al phase and Zn single phase included in an Al/Zn/$Zn_2Mg$ ternary eutectic structure matrix, can be formed. A hot-dip plated steel sheet superior in corrosion resistance and surface appearance can therefore be more advantageously and stably produced. Since for adding Ti and B it is possible to blend in an appropriate amount of a compound of Ti and B such as $TiB_2$, it is therefore possible to use as additives Ti, B and/or $TiB_2$. It is also possible to cause $TiB_2$ to be present in a bath added with Ti/B.

Plating layer alloy compositions obtained by adding appropriate amounts of Ti and B to a hot-dip Zn plating layer are set forth in, for example, JPA-59-166666 (Refinement of Zn—Al alloy crystal grain size by addition of Ti/B), JPA-62-23976 (Refinement of spangles), JPA-2-138451 (Suppression of coating defoliation by impact after painting) and JPA-62-274851 (Improvement of elongation and impact value). However, none of these relates to a Zn—Al—Mg-system hot-dip plating of a composition such as that to which this invention is directed. In other words, the action and effect of Ti/B on structure behaviors such as generation of $Zn_2Mg$-system phase and suppression of $Zn_{11}Mg_2$-system phase have up to now been unknown. Although JPA-2-274851 states that up to 0.2 wt. % of Mg may be contained, it does not contemplate Mg to be contained at not less than 1.0 wt. % as is contemplated by the invention. The inventors newly discovered that in the case of the Zn—Al—Mg-system hot-dip plating of the basic composition of the invention described in the foregoing, when appropriate amounts of Ti/B are added to the hot-dip plating of the basic composition, the size of the $Zn_{11}Mg_2$-system phase becomes extremely small, and that Ti and B enable stable growth of the $Zn_2Mg$-system phase, even at a bath temperature/cooling rate such tends to generate $Zn_{11}Mg_2$-system phase.

Specifically, although Ti and B in the hot-dip plating layer provide an action of suppressing generation/growth of $Zn_{11}Mg_2$-system phase, such action and effect are insufficient at a Ti content of less than 0.002 wt. %. On the other hand, when the Ti content exceeds 0.1 wt. %, Ti—Al-system precipitate grows in the plating layer, whereby bumps arise in the plating layer (called "butsu" among Japanese field engineers) to cause undesirable degradation of appearance. The Ti content is therefore preferably made 0.002–0.1 wt. %. Regarding the B content, at less than 0.001 wt. % the action and effect of suppressing generation/growth of $Zn_{11}Mg_2$ phase is insufficient. When the B content exceeds 0.045 wt. %, on the other hand, the Ti—B or Al—B-system precipitates in the plating layer become coarse, whereby bumps (butsu) arise in the plating layer to cause undesirable degradation of appearance. The B content is therefore preferably made 0.001–0.045 wt. %.

Figure 11:
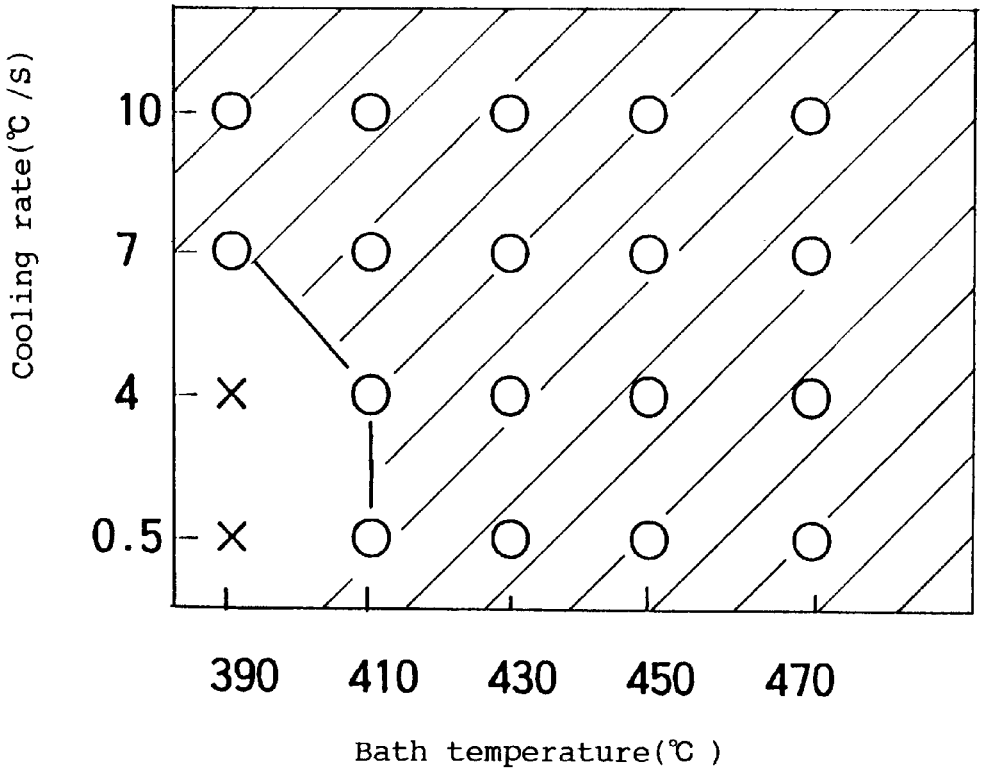
FIG. 11 is a diagram showing the range of conditions advantageous for production the hot-dip Zn—Al—Mg plated steel sheet using a Ti/B-added bath.

It was found that when Ti and B are added to the hot-dip Zn—Al—Mg-system plating bath, since generation/growth of $Zn_{11}Mg_2$-system phase in the plating layer is impeded more than in the case of no addition, the conditions for obtaining the invention metallic structure composed of $Zn_2Mg$-system phase are eased relative to when Ti and Bi are not added, so that it suffices to control the bath temperature of the hot-dip plating bath and the post-plating cooling rate within the typical range of the hatching shown in FIG. 11. The relationship in FIG. 11 is broader in range than the relationship in the earlier FIG. 10. This can be viewed as the effect of Ti/B addition.

This will be explained. In the case of Ti/B addition, as shown in FIG. 11 and indicated in Examples set forth later, when the bath temperature is lower than 410° C. and the cooling rate is less than 7° C./s, the aforesaid $Zn_{11}Mg_2$-system phase appears in spots. More specifically, it was found that the effect of the cooling rate diminishes at bath temperatures above 410° C. so that no $Zn_{11}Mg_2$-system phase appears and the metallic structure defined by the invention can be obtained even at a slow cooling rate such as 0.5/° C. It was similarly found that even at a bath temperature lower than 410° C., the metallic structure defined by the invention can be obtained if the cooling rate is made not less than 7° C./s. This is also a structure state that cannot be predicted from the Zn—Al—Mg equilibrium phase diagram and a phenomenon that cannot be explained by equilibrium theory.

When this phenomenon is utilized, a hot-dip Zn-base plated steel sheet that has a plating layer of the aforesaid metallic structure according to the invention and is good in corrosion resistance and surface appearance can be industrially produced advantageously by, in an in-line annealing-type continuous hot-dip plating machine, conducting hot-dip plating of the steel sheet surface using a hot-dip plating bath composed of Al: 4.0–10 wt. %, Mg: 1.0–4.0 wt. %, Ti: 0.002–0.1 wt. %, B: 0.001–0.045 wt. % and the balance of Zn and unavoidable impurities, controlling the bath temperature of the plating bath to not lower than the melting point and lower than 410° C. and the post-plating cooling rate to not less than 7° C./s, or setting the bath temperature of the plating bath not lower than 410° C. and the post-plating cooling rate arbitrarily (to not less than 0.5° C./s., the lower limit value in an actual practical operation).

Regarding the bath temperature, irrespective of addition/non-addition of Ti/B, it is preferable with the bath composition of the invention to set 550° C. as the upper limit of the bath temperature and to effect the hot-dip plating at a bath temperature not higher than this, because the plating adhesion is degraded when the bath temperature is too high.

Moreover, the matters indicated regarding plating layers not containing Ti/B explained with reference to the photographs of FIGS. 1–8 and the x-ray diffraction charts of FIG. 9 substantially similarly explain the plating layers containing Ti/B. Specifically, at small Ti/B contents such as in this invention, Ti, B, $TiB_2$ and the like substantially do not appear as phases clearly observable in electron microscope secondary-electron micrographs, while by x-ray diffraction they appear merely as extremely small peaks. Therefore, the metallic structure of the invention plated steel sheet containing Ti/B can be explained similarly by the matters explained by FIGS. 1–9 and falls substantially within the same range as the metallic structure of the invention plated steel sheet containing no Ti/B.

Next, explanation will be made regarding the stripe pattern of lines running in the widthwise direction of the sheet that tends to occur in the plating layer of this system and means for suppressing occurrence thereof.

In the case of the foregoing Mg-containing hot-dip Zn-base plated steel sheet, notwithstanding that the corrosion resistance and surface appearance are enhanced from the aspect of the metallic structure of the plating layer, the product value is degraded if the line-like stripe pattern caused by Mg oxidation occurs as mentioned earlier. Through numerous experiments for overcoming this problem repeatedly conducted by use of a continuous hot-dip line as the assumed production line, the inventors discovered that the cause of the occurrence of this peculiar Mg-induced strip pattern is in the morphology of Mg-containing oxide film that is formed during the period up to solidification of the plating layer on the steel strip surface at the time the steel strip is continuously extracted from the bath and that occurrence of the line-like stripe pattern can be prevented by appropriately controlling the morphology of the Mg-containing oxide film, irrespective of other conditions.

This line-like stripe pattern is a pattern produced by the appearance at intervals of relatively broad ribbons extending in the widthwise direction of the sheet. Even if they occur, they pose no problem to the industrial product so long as they are of such a minor degree as not to be distinguishable by visual observation. The "steepness (%)" according to Equation (1) below was therefore adopted as an index for quantifying the degree of the line-like stripe pattern. For this, the undulating shape of the plating surface in the plating direction of the obtained plated steel sheet, i.e., in the direction of strip passage (lengthwise direction of the strip), is measured and the steepness is obtained from the undulating shape curve over a unit length (L). When the steepness exceeds 0.1%, visually distinguishable line-like stripes appear in the widthwise direction of the sheet.

$$\text{Steepness } (\%)=100\times Nm\times(M+V)/L \quad (1),$$

where:

L=Unit length (set to a value not less than $100\times10^3$ $\mu$m such as $250\times10^3$ $\mu$m), Nm=Number of mountains within unit length, M=Average mountain height within unit length ($\mu$m), V=Average valley depth within unit length ($\mu$m).

It is thought that in the state of the steel strip being continuously extracted from the bath, generation of non-equilibrium state solidified structure accompanying generation of intermetallic compound progresses simultaneously with oxidation reaction between metal components and oxygen in the ambient atmosphere during the period up to solidification of the hot-dip plating layer adhering to the surface of the steel strip. When Mg is contained at 1.0 wt. % or greater, however, a Mg-containing oxide film forms on the surface of the molten plating layer, whereby a viscosity differential and/or a mass differential occurs between the surface portion and the interior portion of the plating layer and a change is produced in the surface tension of the surface layer. When the degree of this change exceeds a certain threshold value, a phenomenon of only the surface portion sagging uniformly downward (slipping down) occurs periodically. The line-like stripe pattern referred to above is supposed to result from solidification in this state. In actuality, when a cross-section of the outermost surface layer of the plating layer was elementally analyzed using ESCA, the presence of an oxide film composed of Mg, Al and O (oxygen) to a thickness from the surface of not more than 100 Å was confirmed (substantially no Zn was present) and it was found that the amount of Mg and/or the amount of Al in this film varied subtly with the production conditions. This oxide film is referred to in this specification a Mg-containing oxide film.

Taking this viewpoint, generation of the Mg-containing oxide film should most ideally be totally avoided up to the time that the hot-dip plating layer solidifies. In an actual production line, however, preventing oxidation of the Mg, which has extremely strong oxygen affinity, up to the time the plating layer solidifies is not easy and would require extra equipment and expense to realize.

The inventors therefore conducted various experiments for finding conditions enabling steepness to be kept to or below 0.1% even if formation of Mg-containing oxide film is permitted. As a result, the inventors discovered that for holding steepness to not more than 0.1% it is helpful to keep the oxygen concentration of the wiping gas to not more than 3 vol. % or to provide a sealed box to isolate the hot-dip plated steel strip extracted from the bath from the atmosphere and in the latter case to make the oxygen concentration in the sealed box not greater than 8 vol. %.

Figure 12:
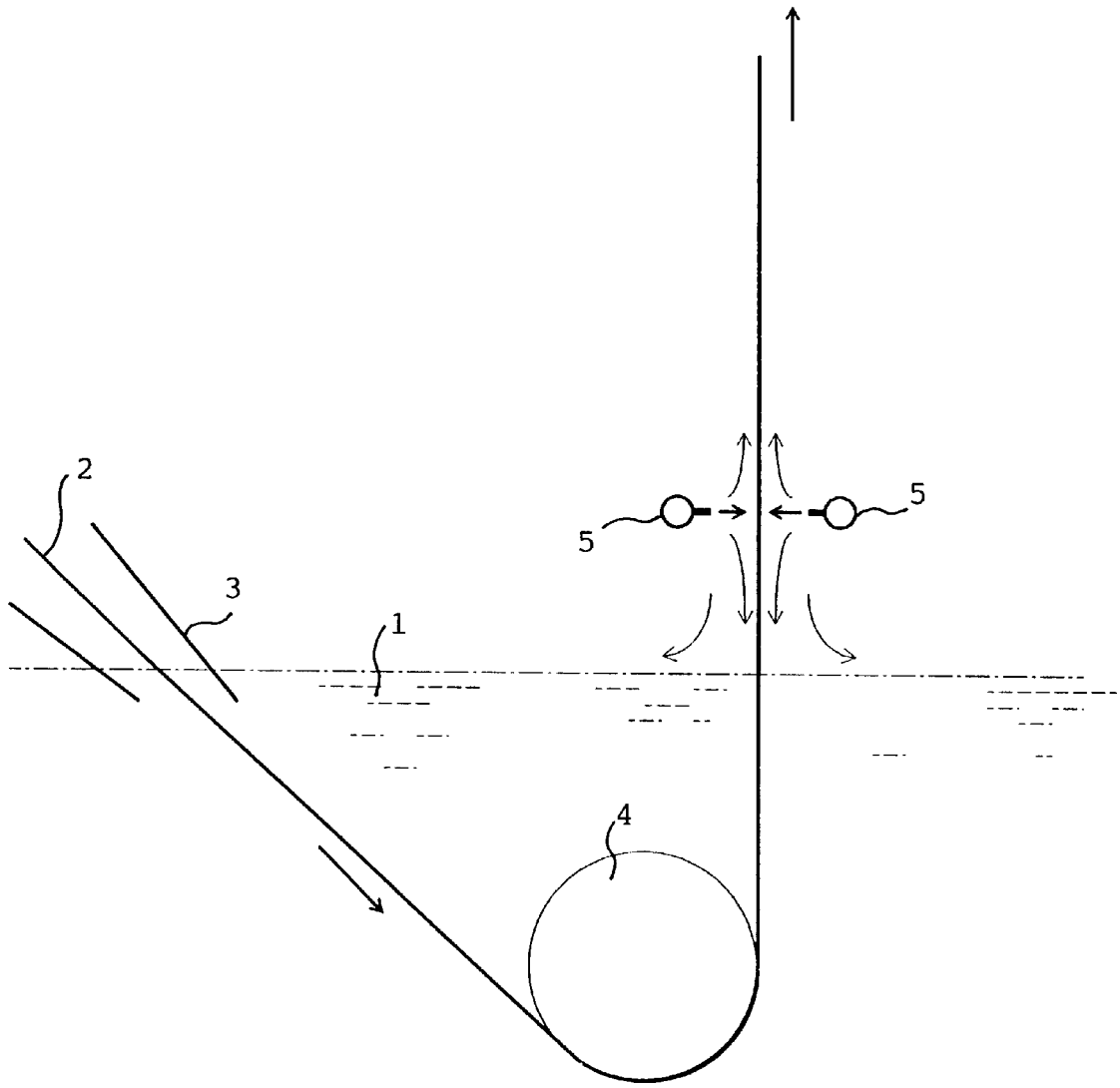
FIG. 12 is a sectional view of the essential portion of a hot-dip plating machine showing how the applied amount of the hot-dip plating layer is adjusted using wiping nozzles installed in atmospheric air.

FIG. 12 schematically illustrates how a steel strip 2 is continuously immersed through a snout 3 into a Zn—Al—Mg-system hot-dip plating bath 1 according to the invention, diverted in direction by an immersed roll 4, and continuously extracted vertically from the hot-dip plating bath 1. Wiping gas for regulating the plating amount (amount applied) is blown from wiping nozzles 5 onto the surfaces of the sheet continuously extracted from the hot-dip plating bath 1. The wiping nozzles 5 are pipes formed with jetting apertures and installed in the widthwise direction of the steel sheet (from the front to the back of the drawing sheet). By blowing gas from these jetting apertures uniformly over the full width of the sheet being continuously extracted, the hot-dip plating layers adhering to the sheet surfaces are reduced to a prescribed thickness.

As explained in detail later, by conducting an investigation of the relationship between the oxygen concentration of the wiping gas and the steepness, it was found that the steepness becomes 0.1% or less without fail when the oxygen concentration is not greater than 3 vol. %. In other words, even if up to 3 vol. % of oxygen in the wiping gas is permitted, the line-like pattern of the Mg-containing hot-dip Zn-base plated steel sheet can be mitigated to the point of posing no problem in terms of appearance. When the wiping gas is blown, a fresh surface at the plating layer interior and the gas make contact at the blown location and the gas passes downward and upward along the sheet surface as a film flow. When the oxygen concentration of the wiping gas exceeds 3 vol. %, the phenomenon of the surface layer portion sagging (slipping down) before the plating layer solidifies readily occurs to cause the steepness to exceed 0.1%.

Figure 13:
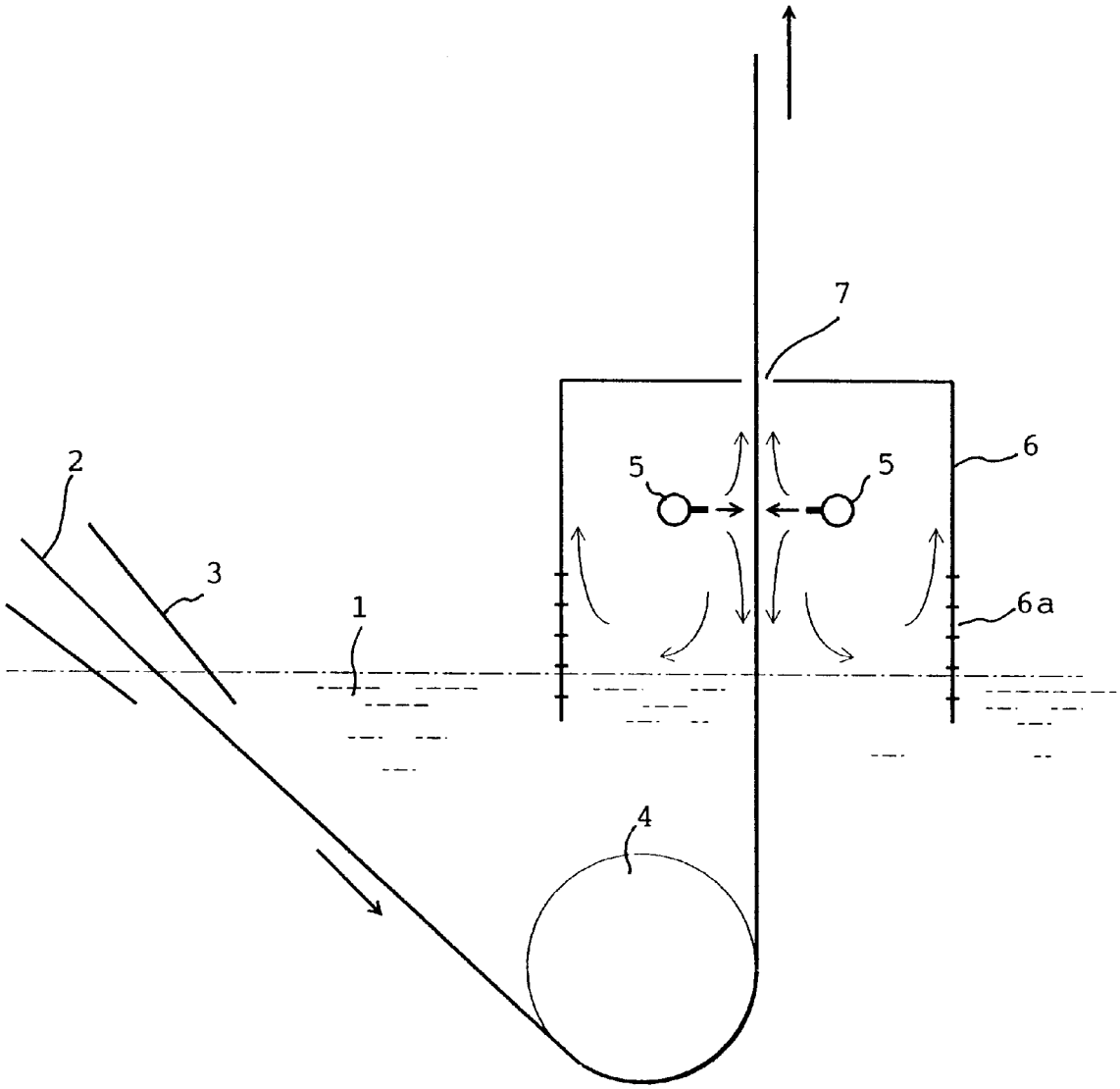
FIG. 13 is a sectional view of the essential portion of a hot-dip plating machine showing how the applied amount of the hot-dip plating layer is adjusted using wiping nozzles installed in a sealed box.

FIG. 13 schematically illustrates the same state as that of FIG. 12, except for the installation of a sealed box 6 for shutting off the sheet extracted from the hot-dip plating bath 1 from the ambient atmosphere. The edge of a skirt portion 6*a* of the sealed box 6 is immersed in the hot-dip plating bath 1 and a slit-like opening 7 is provided at the center of the ceiling of the sealed box 6 for passage of the steel strip 2. The wiping nozzles 5 are installed inside the sealed box 6. Substantially all of the gas jetted from the wiping nozzles 5 is discharged from the box through the opening 7. It was found that when this type of sealed box 6 is provided, steepness can be kept to not greater than 0.1% even if the an oxygen concentration within the sealed box 6 of up to 8 vol. % is permitted. For maintaining the oxygen concentration in the box at not greater than 8 vol. %, it suffices to set the oxygen concentration of the gas blown from the wiping nozzles 5 in the box at not greater than 8 vol. %. When the sealed box 6 is provided as shown in FIG. 13, therefore, the oxygen concentration of the wiping gas blown form the wiping nozzles 5 can be allowed be still higher than in the case of FIG. 12.

By means of such regulation of the oxygen concentration of the wiping gas or the atmosphere inside the sealed box, the morphology of the Mg-containing oxide film of the hot-dip plating surface layer can be made a morphology involving no appearance of a line-like stripe pattern. It was found, however, that occurrence of a line-like stripe pattern can also be similarly suppressed by other means than this, namely, by means of adding an appropriate amount of Be to the bath.

Specifically, occurrence of a line-like stripe pattern can be suppressed by adding an appropriate amount of Be to the basic bath composition according to the invention. The reason for this is conjectured to be that in the outermost surface layer of the pre-solidified hot-dip plating that exits the plating bath, Be oxidizes preferentially to Mg, and as a result, oxidation of Mg is suppressed to prevent occurrence of a Mg-containing oxide film of the nature that produces a line-like stripe pattern.

While the pattern suppressing effect of Be addition starts from a Be content in the bath of around 0.001 wt. % and strengthens with increasing content, the effect saturates at about 0.05 wt. %. Moreover, when Be is present at greater than 0.05 wt. %, it begins to have an adverse effect on the corrosion resistance of the plating layer. The amount of Be addition to the bath is therefore preferably in the range of 0.001–0.05 wt. %. (Since the line-like stripe pattern tends to become more apparent with increasing plating amount, it is advisable when attempting to suppress it by Be addition to regulate the amount of Be addition within the aforesaid range based on the plating amount.)

Although the suppression of stripe pattern by Be addition can be effected independently of the regulation of the oxygen concentration of the wiping gas or the atmosphere in the sealed box, it can also be effected together with the oxygen concentration regulation method. The effect of stripe pattern suppression by Be addition is manifested both with respect to a Ti/B-added bath for suppressing generation of $Zn_{11}Mg_2$-system phase and with respect to a bath not added with Ti/B, without adversely affecting generation of a $Zn_2Mg$-system metallic structure.

Therefore as a hot-dip plated steel sheet obtained using a Be-added bath, the invention also provides a hot-dip Zn—Al—Mg-system plated steel sheet with no stripe pattern and having good corrosion resistance and surface appearance that is a hot-dip Zn-base plated steel sheet obtained by forming on a surface of a steel sheet a plating layer composed of Al: 4.0–10 wt. %, Mg: 1.0–4.0 wt. %, Be: 0.001–0.05 wt. % and, as required, Ti: 0.002–0.1 wt. % and B: 0.001–0.045 wt. %, and the balance of Zn and unavoidable impurities, the plating layer having a metallic structure including a primary crystal Al phase or a primary crystal Al phase and a Zn single phase in a matrix of $Al/Zn/Zn_2Mg$ ternary eutectic structure.

EXAMPLES

Example 1

Regarding effect of plating composition (particularly Mg content) on corrosion resistance and productivity.

{Processing conditions}

Processing equipment:

Sendzimir-type continuous hot-dip plating line

Processed steel sheet:

Hot-rolled steel strip (thickness: 3.2 mm) of medium-carbon steel

Maximum temperature reached by sheet in reduction furnace within line:

600° C.

Dew point of atmosphere in reduction furnace:

−40° C.

Plating bath composition:

Al=4.0–9.2 wt. %, Mg=0–5.2 wt. %, balance=Zn

Plating bath temperature:

455° C.

Period of steel strip immersion in plating bath:

3s

Post-plating cooling rate: (Average value from bath temperature to plating layer solidification temperature; the same in the following Examples):

3° C./s or 12° C./s by the air cooling method

Hot-dip Zn—Al—Mg plated steel strip was produced under the foregoing conditions. The amount of oxide (dross) generated on the bath surface at this time was observed and the hot-dip plated steel sheet obtained was tested for corrosion resistance. Corrosion resistance was evaluated based on corrosion loss ($g/m^2$) after conducting SST (saltwater spray test according to JIS-Z-2371) for 800 hours. Amount of dross generation was visually observed and rated X for large amount, Δ for rather large amount and ⊚ for small amount. The results are shown in Table 1.

TABLE 1

| No | Al | Mg | Cooling rate ° C./s | SST corrosion loss $g/m^2$ | Form of corrosion | Bath surface oxide |
|---|---|---|---|---|---|---|
| 1 | 6.0 | 0 | 12 | 90 | Uniform | ⊚ |
| 2 | 6.0 | 0.1 | 12 | 78 | Uniform | ⊚ |
| 3 | 6.0 | 0.5 | 12 | 40 | Uniform | ⊚ |
| 4 | 6.0 | 1.0 | 12 | 22 | Uniform | ⊚ |
| 5 | 6.0 | 2.0 | 12 | 19 | Uniform | ⊚ |
| 6 | 6.0 | 3.0 | 12 | 16 | Uniform | ⊚ |
| 7 | 6.0 | 4.0 | 12 | 14 | Uniform | ⊚ |
| 8 | 6.0 | 5.0 | 12 | 14 | Uniform | x |
| 9 | 6.0 | 3.0 | 3 | 42 | Preferential corrosion of $Zn_{11}Mg_2$ portions | ⊚ |
| 10 | 4.0 | 0.1 | 12 | 82 | Uniform | ⊚ |
| 11 | 4.0 | 1.2 | 12 | 25 | Uniform | ⊚ |
| 12 | 4.0 | 2.0 | 12 | 22 | Uniform | ⊚ |
| 13 | 4.0 | 3.8 | 12 | 16 | Uniform | ⊚ |
| 14 | 4.0 | 5.2 | 12 | 16 | Uniform | x |
| 15 | 4.0 | 2.0 | 3 | 48 | Preferential corrosion of $Zn_{11}Mg_2$ portions | ⊚ |
| 16 | 9.2 | 0.5 | 12 | 37 | Uniform | ⊚ |
| 17 | 9.2 | 3.1 | 12 | 14 | Uniform | ⊚ |
| 18 | 9.2 | 5.0 | 12 | 14 | Uniform | Δ |
| 19 | 9.2 | 1.5 | 3 | 40 | Preferential corrosion of $Zn_{11}Mg_2$ portions | ⊚ |

From the results in Table 1, it can be seen that the corrosion resistance improves rapidly as the Mg content reaches exceeds 1% but saturates when 4% or more is added. It can e seen that at a Mg content exceeding 4%, oxide (dross) bath surface increases even though Al is contained. At a cooling rate of 3° C./s, $Zn_{11}Mg_2$-system phase crystallizes and these portions corrode preferentially.

Example 2

Regarding effect of plating composition (particularly Al content) on corrosion resistance and adherence.

{Processing conditions}

Processing equipment:

Sendzimir-type continuous hot-dip plating line

Processed steel sheet:

Hot-rolled steel strip (thickness: 1.6 mm) of medium-carbon steel

Maximum temperature reached by sheet in reduction furnace:

600° C.

Dew point of atmosphere in reduction furnace:

−40° C.

Plating bath composition:

Al=0.15–13.0 wt. %, Mg=3.0 wt. %, balance=Zn

Plating bath temperature:

460° C.

Period of immersion:

3s

Post-plating cooling rate

12° C./s by the air cooling method

Hot-dip Zn—Al—Mg plated steel strip was produced under the foregoing conditions. The hot-dip plated steel sheet obtained was tested for corrosion resistance and adherence. As in Example 1, corrosion resistance was evaluated based on corrosion loss (g/m$^2$) after conducting SST for 800 hours. Adherence was evaluated by tightly bending a sample, subjecting the bend portion to an adhesive tape peeling test, and rating lack k of peeling as ⊙, less than 5% peeling as Δ and 5% or greater peeling as X. The results are shown in Table 2.

TABLE 2

| No | Al | Mg | Cooling rate ° C./s | SST corrosion loss g/m$^2$ | Form of corrosion | Adherence |
|---|---|---|---|---|---|---|
| 1 | 0.15 | 3.0 | 12 | 35 | Uniform | ⊙ |
| 2 | 2.0 | 3.0 | 12 | 29 | Uniform | ⊙ |
| 3 | 4.0 | 3.0 | 12 | 18 | Uniform | ⊙ |
| 4 | 5.5 | 3.0 | 12 | 17 | Uniform | ⊙ |
| 5 | 7.0 | 3.0 | 12 | 16 | Uniform | ⊙ |
| 6 | 9.0 | 3.0 | 12 | 14 | Uniform | ⊙ |
| 7 | 10.5 | 3.0 | 12 | 14 | Uniform | ⊙ |
| 8 | 13.0 | 3.0 | 12 | 14 | Uniform | x |

As can be seen from the results in Table 2, corrosion resistance is excellent at an Al content of not less than 4.0% but adherence is bad at over 10%. This is caused by abnormal development of an alloy layer (Fe—Al alloy layer).

Example 3

Regarding effect of bath temperature and cooling rate on structure and relationship between structure and surface appearance.

{Processing conditions}

Processing equipment:

Sendzimir-type continuous hot-dip plating line

Processed steel sheet:

Hot-rolled steel strip of weakly killed steel (in-line pickled; thickness: 2.3 mm)

Maximum temperature reached by sheet in reduction furnace:

580° C.

Dew point of atmosphere in reduction furnace:

−30° C.

Plating bath composition:

Al=4.8–9.6 wt. %, Mg=1.1–3.9 wt. %, balance=Zn

Plating bath temperature:

390–535° C.

Period of immersion:

8s or less

Post-plating cooling rate:

3–11° C./s by the air cooling method

Hot-dip plated steel strip was first produced under the foregoing conditions using a Zn-6.2%Al-3.0% Mg bath composition, while varying the plating bath temperature and the post-plating cooling rate. The structure and appearance of the plating layer of the plated steel sheet obtained were examined. The results are shown in Table 3.

Among the plating layer structures in Table 3, that represented by $Zn_2Mg$ is the metallic structure defined by the invention, i.e., a metallic structure of primary crystal Al phase or primary crystal Al phase and Zn single phase in an Al/Zn/$Zn_2Mg$ ternary eutectic structure matrix, wherein actually the total of primary crystal Al phase and Al/Zn/$Zn_2Mg$ ternary eutectic structure is not less than 80 vol. % and the total of Zn single phase is not more than 15 vol. %.

Further, $Zn_2Mg$+$Zn_{11}Mg_2$ in Table 3 represents a structure of spot-like $Zn_{11}Mg_2$-system phase of visibly distinguishable size, like that shown in FIG. 5, in the $Zn_2Mg$-system structure. As shown in FIG. 6, this spot-like $Zn_{11}Mg_2$-system phase is a spot-like phase of Al primary crystal or Al primary crystal and Zn single phase included in an Al/Zn/$Zn_{11}Mg_2$ ternary eutectic structure matrix. As the spot-like $Zn_{11}Mg_2$-system phase is shiner than the surrounding phase, it forms a noticeable pattern. When left to stand indoors for about 24 hours, this portion oxidizes ahead of the other portions and discolors to light brown, making it stand out even more. The evaluation of appearance in Table 3 was therefore made by visually observing the surface immediately after plating and 24 hours after plating. Depending on whether or not $Zn_{11}Mg_2$-system phase crystallized, the appearance was rated uneven if spots were visually observed and even if no spots were visually observed.

TABLE 3

| No | Bath Composition Wt. % Al | Bath Composition Wt. % Mg | Plating Bath Temp. ° C. | Cooling Rate ° C./s | Intermetallic Compound in Plating layer Structure Ternary eutectic | Appearance |
|---|---|---|---|---|---|---|
| 1 | 6.2 | 3.0 | 390 | 11 | $Zn_2Mg$ | Even |
| 2 | 6.2 | 3.0 | 410 | 11 | $Zn_2Mg$ | Even |
| 3 | 6.2 | 3.0 | 430 | 11 | $Zn_2Mg$ | Even |
| 4 | 6.2 | 3.0 | 450 | 11 | $Zn_2Mg$ | Even |
| 5 | 6.2 | 3.0 | 470 | 3 | $Zn_2Mg$ | Even |
| 6 | 6.2 | 3.0 | 470 | 5 | $Zn_2Mg$ | Even |
| 7 | 6.2 | 3.0 | 470 | 9 | $Zn_2Mg$ | Even |
| 8 | 6.2 | 3.0 | 470 | 11 | $Zn_2Mg$ | Even |
| 9 | 6.2 | 3.0 | 535 | 3 | $Zn_2Mg$ | Even |
| 10 | 6.2 | 3.0 | 535 | 5 | $Zn_2Mg$ | Even |
| 11 | 6.2 | 3.0 | 535 | 9 | $Zn_2Mg$ | Even |
| 12 | 6.2 | 3.0 | 535 | 11 | $Zn_2Mg$ | Even |
| 13 | 6.2 | 3.0 | 390 | 3 | $Zn_2Mg$ + $Zn_{11}Mg_2$ | Uneven |
| 14 | 6.2 | 3.0 | 390 | 6 | $Zn_2Mg$ + $Zn_{11}Mg_2$ | Uneven |
| 15 | 6.2 | 3.0 | 390 | 9 | $Zn_2Mg$ + $Zn_{11}Mg_2$ | Uneven |
| 16 | 6.2 | 3.0 | 460 | 3 | $Zn_2Mg$ + $Zn_{11}Mg_2$ | Uneven |
| 17 | 6.2 | 3.0 | 460 | 6 | $Zn_2Mg$ + $Zn_{11}Mg_2$ | Uneven |
| 18 | 6.2 | 3.0 | 460 | 9 | $Zn_2Mg$ + $Zn_{11}Mg_2$ | Uneven |

From the results in Table 3, it can be seen that when the bath temperature is below 470° C. and the cooling rate is low (below 10° C./s), $Zn_{11}Mg_2$-system phase appears and makes the apperance uneven. On the other hand, even when the bath temperature is below 470° C., substantially primary crystal Al phase and Al/Zn/$Zn_2Mg$ ternary eutectic structure are obtained and an even appearance is exhibited if the cooling rate is high (not less than 10° C./s). Similarly, at a bath temperature of 470° C. or higher, substantially primary crystal Al phase and Al/Zn/$Zn_2Mg$ ternary eutectic structure are obtained and an even appearance exhibited even if the cooling rate is low.

Further, hot-dip plated steel strip was similarly produced, except for changing the bath composition to Zn-4.3%Al-1.2% Mg, Zn-4.3%Al-2.6% Mg or Zn-4.3%Al-3.8% Mg, while varying the plating bath temperature and the post-plating cooling rate in the manner of Table 3. The structure and appearance of the plating layer of the plated steel sheet obtained were similarly examined. Exactly the same results as shown in Table 3 were obtained. Hot-dip plated steel strip was also similarly produced, except for changing the bath composition to Zn-6.2%Al-1.5% Mg or Zn-6.2%Al-3.8% Mg, while varying the plating bath temperature and the post-plating cooling rate in the manner of Table 3. The structure and appearance of the plating layer of the plated steel sheet obtained were examined as in the preceding examples. Exactly the same results as shown in Table 3 were obtained. Hot-dip plated steel strip was also similarly produced, except for changing the bath composition to Zn-9.6%Al-1.1% Mg, Zn-9.6%Al-3.0% Mg or Zn-9.6%Al-3.9% Mg, while varying the plating bath temperature and the post-plating cooling rate in the manner of Table 3. The structure and appearance of the plating layer of the plated steel sheet obtained were examined as in the preceding examples. Exactly the same results as shown in Table 3 were obtained. These results are consolidated in FIG. 10. If a bath temperature and cooling rate in the hatched region shown in FIG. 10 are adopted, then, by the basic bath composition according to the invention, there is obtained a plating layer of a metallic structure composed substantially of primary crystal Al phase and Al/Zn/$Zn_2$Mg ternary eutectic structure or of these plus a small amount of Zn single phase. As a result, there can be obtained a hot-dip Zn—Al—Mg plated steel sheet having a plating layer excellent in corrosion resistance and surface appearance.

Example 4

Regarding effect of bath temperature and cooling rate on plating adherence.

{Processing conditions}

Processing equipment:

NOF-type continuous hot-dip plating line

Processed steel sheet:

Cold-rolled steel strip (thickness: 0.8 mm) of weakly killed steel

Maximum temperature reached by sheet in reduction furnace:

780° C.

Dew point of atmosphere in reduction furnace:

−25° C.

Plating bath composition:

Al=4.5–9.5 wt. %, Mg=1.5–3.9 wt. %, balance=Zn

Plating bath temperature:

400–590° C.

Period of immersion:

3s

Post-plating cooling rate:

3° C./s or 12° C./s by the air cooling method

Hot-dip plated steel strip was produced under the foregoing conditions and the plating adherence of the plated steel sheet obtained was examined. The results are shown in Table 4. Plating adherence was evaluated as in Example 2.

TABLE 4

| No | Al | Mg | Bath temp. ° C./s | Cooling rate ° C./s | Adherence |
|---|---|---|---|---|---|
| 1 | 6.0 | 2.5 | 400 | 12 | ◎ |
| 2 | 6.0 | 2.5 | 450 | 12 | ◎ |
| 3 | 6.0 | 2.5 | 540 | 3 | ◎ |
| 4 | 6.0 | 2.5 | 540 | 12 | ◎ |
| 5 | 6.0 | 2.5 | 560 | 3 | x |
| 6 | 6.0 | 2.5 | 560 | 12 | Δ |
| 7 | 6.0 | 2.5 | 590 | 3 | x |
| 8 | 6.0 | 2.5 | 590 | 12 | x |
| 9 | 4.5 | 1.5 | 430 | 12 | ◎ |
| 10 | 4.5 | 1.5 | 450 | 12 | ◎ |
| 11 | 4.5 | 1.5 | 540 | 3 | ◎ |
| 12 | 4.5 | 1.5 | 540 | 12 | ◎ |
| 13 | 4.5 | 1.5 | 560 | 3 | x |
| 14 | 4.5 | 1.5 | 560 | 12 | Δ |
| 15 | 4.5 | 1.5 | 590 | 3 | x |
| 16 | 4.5 | 1.5 | 590 | 12 | x |
| 17 | 4.5 | 3.9 | 430 | 12 | ◎ |
| 18 | 4.5 | 3.9 | 450 | 12 | ◎ |
| 19 | 4.5 | 3.9 | 540 | 3 | ◎ |
| 20 | 4.5 | 3.9 | 540 | 12 | ◎ |
| 21 | 4.5 | 3.9 | 560 | 3 | x |
| 22 | 4.5 | 3.9 | 560 | 12 | Δ |
| 23 | 4.5 | 3.9 | 590 | 3 | x |
| 24 | 4.5 | 3.9 | 590 | 12 | x |
| 25 | 9.5 | 3.8 | 450 | 12 | ◎ |
| 26 | 9.5 | 3.8 | 540 | 3 | ◎ |
| 27 | 9.5 | 3.8 | 540 | 12 | ◎ |
| 28 | 9.5 | 3.8 | 560 | 3 | x |
| 29 | 9.5 | 3.8 | 560 | 12 | x |
| 30 | 9.5 | 3.8 | 590 | 3 | x |
| 31 | 9.5 | 3.8 | 590 | 12 | x |

From the results in Table 4, it can be seen that in the bath composition range of the invention the plating adherence is poor irrespective of the cooling rate when the bath temperature is higher than 550° C.

Example 5

Regarding effect of plating composition (particularly Ti/B contents) on corrosion resistance and adherence.

{Processing conditions}

Processing equipment:

Sendzimir-type continuous hot-dip plating line

Processed steel sheet:

Hot-rolled steel strip of weakly killed steel (in-line pickled), thickness: 2.3 mm Maximum temperature reached by sheet in reduction furnace:

580° C.

Dew point of atmosphere in reduction furnace:

−30° C.

Plating bath composition:

Al=6.2 wt. %

Mg=3.0 wt. %

Ti=0–0.135 wt. %

B=0–0.081 wt. %

Balance=Zn

Plating bath temperature:

450° C.

Period of immersion:

4s or less

Post-plating cooling rate:

4° C./s by the air cooling method

Hot-dip Zn—Al—Mg (Ti/B) plated steel sheet was produced under the foregoing conditions. The structure and surface appearance of the plating layer of the plated steel sheet obtained was investigated. The results are shown in Table 5.

TABLE 5

| No | Bath Composition wt. % Al | Mg | Ti | B | Plating Composition | Appearance Spot | Bump |
|---|---|---|---|---|---|---|---|
| 1 | 6.2 | 3.0 | None | None | $Zn_2Mg + Zn_{11}Mg_2$ | YES | NO |
| 2 | 6.2 | 3.0 | 0.001 | 0.0005 | $Zn_2Mg + Zn_{11}Mg_2$ | YES | NO |
| 3 | 6.2 | 3.0 | 0.001 | 0.003 | $Zn_2Mg + Zn_{11}Mg_2$ | YES | NO |
| 4 | 6.2 | 3.0 | 0.001 | 0.045 | $Zn_2Mg + Zn_{11}Mg_2$ | YES | NO |
| 5 | 6.2 | 3.0 | 0.001 | 0.081 | $Zn_2Mg + Zn_{11}Mg_2$ | YES | YES |
| 6 | 6.2 | 3.0 | 0.002 | 0.0005 | $Zn_2Mg + Zn_{11}Mg_2$ | YES | NO |
| 7 | 6.2 | 3.0 | 0.002 | 0.001 | $Zn_2Mg$ | NO | NO |
| 8 | 6.2 | 3.0 | 0.002 | 0.043 | $Zn_2Mg$ | NO | NO |
| 9 | 6.2 | 3.0 | 0.002 | 0.051 | $Zn_2Mg$ | NO | YES |
| 10 | 6.2 | 3.0 | 0.010 | 0.0006 | $Zn_2Mg + Zn_{11}Mg_2$ | YES | NO |
| 12 | 6.2 | 3.0 | 0.010 | 0.002 | $Zn_2Mg$ | NO | NO |
| 13 | 6.2 | 3.0 | 0.010 | 0.030 | $Zn_2Mg$ | NO | NO |
| 14 | 6.2 | 3.0 | 0.010 | 0.049 | $Zn_2Mg$ | NO | YES |
| 15 | 6.2 | 3.0 | 0.040 | 0.0008 | $Zn_2Mg + Zn_{11}Mg_2$ | YES | NO |
| 16 | 6.2 | 3.0 | 0.040 | 0.004 | $Zn_2Mg$ | NO | NO |
| 17 | 6.2 | 3.0 | 0.040 | 0.015 | $Zn_2Mg$ | NO | NO |
| 18 | 6.2 | 3.0 | 0.040 | 0.045 | $Zn_2Mg$ | NO | NO |
| 19 | 6.2 | 3.0 | 0.040 | 0.061 | $Zn_2Mg$ | NO | YES |
| 20 | 6.2 | 3.0 | 0.080 | 0.008 | $Zn_2Mg + Zn_{11}Mg_2$ | YES | NO |
| 21 | 6.2 | 3.0 | 0.080 | 0.002 | $Zn_2Mg$ | NO | NO |
| 22 | 6.2 | 3.0 | 0.080 | 0.035 | $Zn_2Mg$ | NO | NO |
| 23 | 6.2 | 3.0 | 0.080 | 0.055 | $Zn_2Mg$ | NO | YES |
| 24 | 6.2 | 3.0 | 0.100 | 0.0007 | $Zn_2Mg + Zn_{11}Mg_2$ | YES | NO |
| 25 | 6.2 | 3.0 | 0.100 | 0.002 | $Zn_2Mg$ | NO | NO |
| 26 | 6.2 | 3.0 | 0.100 | 0.030 | $Zn_2Mg$ | NO | NO |
| 27 | 6.2 | 3.0 | 0.100 | 0.051 | $Zn_2Mg$ | NO | YES |
| 28 | 6.2 | 3.0 | 0.135 | 0.0008 | $Zn_2Mg + Zn_{11}Mg_2$ | YES | YES |
| 29 | 6.2 | 3.0 | 0.135 | 0.015 | $Zn_2Mg$ | NO | YES |
| 30 | 6.2 | 3.0 | 0.135 | 0.055 | $Zn_2Mg$ | NO | YES |

Among the plating layer structures shown in Table 5, those represented as $Zn_2Mg$ are composed of primary crystal Al phase and Al/Zn/$Zn_2Mg$ ternary eutectic structure in a total of not less than 80 vol. % and Zn single phase in an amount of not more than 15 vol. %. The ones represented as $Zn_2Mg+Zn_{11}Mg_2$are those in which spot-like $Zn_{11}Mg_2$-system phase appeared in the structure having $Zn_2Mg$-system phase at a visibly distinguishable size. As the spot-like $Zn_{11}Mg_2$-system phase is shiner than the surrounding phase, it forms a noticeable pattern. When left to stand indoors for about 24 hours, this portion oxidizes ahead of the other portions and discolors to light brown, making it stand out even more. In the evaluation of appearance in FIG. 5, Spot YES and Spot NO indicate those in which $Zn_{11}Mg_2$-system phase spots were and were not found upon visual observation of the surface immediately after plating and 24 hours after plating. Bump (YES) indicates those in which irregularities formed in the plating layer owing to precipitates growing to large size in the plating layer.

From the results in Table 5, it can be seen that Ti/B addition impedes crystallization of $Zn_{11}Mg_2$-system phase spots to provide a good surface condition. Of particular note is that this effect is slight by B alone and that the effect is manifest by combined addition of Ti and B. However, bumps occur to degrade the surface condition when the Ti/B content is above the range prescribed by the invention.

Production was repeated under the same conditions as those of Example 5 except that the plating bath composition was changed to the following (1)–(5), namely:

(1) Al=4.0 wt. %
Mg=1.2 wt. %
Ti=0–0.135 wt. %
B=0–0.081 wt. %
Balance=Zn (2) Al=4.2 wt. %
Mg=3.2 wt. %
Ti=0–0.135 wt. %
B=0–0.081 wt. %
Balance=Zn (3) Al=6.2 wt. %
Mg=1.1 wt. %
Ti=0–0.135 wt. %
B=0–0.081 wt. %
Balance=Zn (4) Al=6.1 wt. %
Mg=3.9 wt. %
Ti=0–0.135 wt. %
B=0–0.081 wt. %
Balance=Zn (5) Al=9.2 wt. %
Mg=3.8 wt. %
Ti=0–0.135 wt. %
B=0–0.081 wt. %
Balance=Zn As a result, platings of exactly the same plating structure and appearance evaluation as those with the Ti contents/B contents shown in Table 5 were also obtained when the Al content and Mg content were varied in the manner of (1)–(5). In other words, it was found that the result of Ti and B addition is manifested in the range of Al and Mg addition defined by the invention irrespective of the amount of Al and the amount of Mg.

Example 6

Regarding effect of Ti/B addition/non-addition, bath temperature and cooling rate on structure and surface appearance of plating layer.

{Processing conditions}

Processing equipment:
Sendzimir-type continuous hot-dip plating line

Processed steel sheet:
Hot-rolled steel strip of weakly killed steel (in-line pickled), thickness: 2.3 mm Maximum temperature reached by sheet in reduction furnace:
580° C.

Dew point of atmosphere in reduction furnace:
−30° C.

Plating bath composition:
Al=6.2 wt. %
Mg=3.0 wt. %
Ti=0 or 0.030 wt. %
B=0 or 0.015 wt. %
Balance=Zn Plating bath temperature:
390–500° C.

Period of immersion:
5s or less

Post-plating cooling rate:
0.5–10° C./s by the air cooling method

Hot-dip plated steel sheet was produced under the foregoing conditions, while varying the bath temperature and the post-plating cooling rate. The structure and surface appearance of the plating of the plated steel sheet obtained was investigated. The results are shown in Table 6. The designation of plating structure and the presence/absence of spots in the appearance evaluation in Table 6 are the same as those explained regarding Table 5.

TABLE 6

| No | Bath composition wt. % Al | Mg | Ti | B | Bath temp. ° C. | Cooling rate ° C./s | Plating layer composition | Appearance evaluation Presence of spots |
|---|---|---|---|---|---|---|---|---|
| 1 | 6.2 | 3.0 | 0.030 | 0.015 | 390 | 0.5 | $Zn_2Mg + Zn_{11}Mg_2$ | YES |
| 2 | 6.2 | 3.0 | 0.030 | 0.015 | 390 | 4 | $Zn_2Mg + Zn_{11}Mg_2$ | YES |
| 3 | 6.2 | 3.0 | 0.030 | 0.015 | 390 | 7 | $Zn_2Mg$ | NO |
| 4 | 6.2 | 3.0 | 0.030 | 0.015 | 390 | 10 | $Zn_2Mg$ | NO |
| 5 | 6.2 | 3.0 | 0.030 | 0.015 | 410 | 0.5 | $Zn_2Mg$ | NO |
| 6 | 6.2 | 3.0 | 0.030 | 0.015 | 410 | 4 | $Zn_2Mg$ | NO |
| 7 | 6.2 | 3.0 | 0.030 | 0.015 | 410 | 7 | $Zn_2Mg$ | NO |
| 8 | 6.2 | 3.0 | 0.030 | 0.015 | 430 | 0.5 | $Zn_2Mg$ | NO |
| 9 | 6.2 | 3.0 | 0.030 | 0.015 | 430 | 4 | $Zn_2Mg$ | NO |
| 10 | 6.2 | 3.0 | 0.030 | 0.015 | 430 | 7 | $Zn_2Mg$ | NO |
| 11 | 6.2 | 3.0 | 0.030 | 0.015 | 460 | 0.5 | $Zn_2Mg$ | NO |
| 12 | 6.2 | 3.0 | 0.030 | 0.015 | 460 | 4 | $Zn_2Mg$ | NO |
| 13 | 6.2 | 3.0 | 0.030 | 0.015 | 460 | 7 | $Zn_2Mg$ | NO |
| 14 | 6.2 | 3.0 | 0.030 | 0.015 | 500 | 0.5 | $Zn_2Mg$ | NO |
| 15 | 6.2 | 3.0 | 0.030 | 0.015 | 500 | 4 | $Zn_2Mg$ | NO |
| 16 | 6.2 | 3.0 | 0.030 | 0.015 | 500 | 7 | $Zn_2Mg$ | NO |
| 17 | 6.2 | 3.0 | None | None | 410 | 0.5 | $Zn_2Mg + Zn_{11}Mg_2$ | YES |
| 18 | 6.2 | 3.0 | None | None | 410 | 4 | $Zn_2Mg + Zn_{11}Mg_2$ | YES |
| 19 | 6.2 | 3.0 | None | None | 410 | 7 | $Zn_2Mg + Zn_{11}Mg_2$ | YES |
| 20 | 6.2 | 3.0 | None | None | 430 | 0.5 | $Zn_2Mg + Zn_{11}Mg_2$ | YES |
| 21 | 6.2 | 3.0 | None | None | 430 | 4 | $Zn_2Mg + Zn_{11}Mg_2$ | YES |
| 22 | 6.2 | 3.0 | None | None | 430 | 7 | $Zn_2Mg + Zn_{11}Mg_2$ | YES |
| 23 | 6.2 | 3.0 | None | None | 460 | 0.5 | $Zn_2Mg + Zn_{11}Mg_2$ | YES |
| 24 | 6.2 | 3.0 | None | None | 460 | 4 | $Zn_2Mg + Zn_{11}Mg_2$ | YES |
| 25 | 6.2 | 3.0 | None | None | 460 | 7 | $Zn_2Mg + Zn_{11}Mg_2$ | YES |

From the results in Table 6, it can be seen that, compared with platings not added with Ti/B, those added with Ti/B do not experience $Zn_{11}Mg_2$-system phase spots even a low bath temperature/slow cooling rate. Specifically, if hot-dip plating treatment is effected at a bath temperature and a cooling rate in the hatched region shown in FIG. 11, those added with Ti/B substantially become primary crystal Al phase and $Al/Zn/Zn_2Mg$ ternary eutectic structure, thereby providing a product exhibiting uniform appearance without $Zn_{11}Mg_2$-system spots. In contrast, in the case of no Ti/B addition, $Zn_{11}Mg_2$-system phase spots appear unless, as shown in FIG. 11, the bath temperature is made, preferably, not less than 470° C. or, at under 470° C., if the cooling rate is made 10° C./sec or greater.

Example 7

Regarding effect of plating composition (particularly Al content in case of Ti/B addition) on corrosion resistance and adherence.

{Processing conditions}

Processing equipment:

Sendzimir-type continuous hot-dip plating line

Processed steel sheet:

Hot-rolled steel strip (thickness: 1.6 mm) of medium-carbon steel

Maximum temperature reached by sheet in reduction furnace:

600° C.

Dew point of atmosphere in reduction furnace:

−40° C.

Plating bath composition:

Al=0.15–13.0 wt. %

Mg=3.0 wt. %

Ti=0.05 wt. %

B=0.025 wt. %

Balance=Zn

Plating bath temperature:

440° C.

Period of immersion:

3s

Post-plating cooling rate:

4° C./s by the air cooling method

Hot-dip Zn—Al—Mg (Ti/B) plated steel strip was produced under the foregoing conditions. The hot-dip plated steel sheet obtained was tested for corrosion resistance and adherence in the same manner as in Example 2. The results are shown in Table 7.

TABLE 7

| No | Plating bath composition (wt. %) Al | Mg | Ti | B | SST corrosion loss g/m² | Adherence |
|---|---|---|---|---|---|---|
| 1 | 0.15 | 3.0 | 0.05 | 0.025 | 35 | ◎ |
| 2 | 2.0 | 3.0 | 0.05 | 0.025 | 29 | ◎ |
| 3 | 4.0 | 3.0 | 0.05 | 0.025 | 18 | ◎ |
| 4 | 5.5 | 3.0 | 0.05 | 0.025 | 17 | ◎ |
| 5 | 7.0 | 3.0 | 0.05 | 0.025 | 16 | ◎ |
| 6 | 9.0 | 3.0 | 0.05 | 0.025 | 14 | ◎ |
| 7 | 10.5 | 3.0 | 0.05 | 0.025 | 14 | Δ |
| 8 | 13.5 | 3.0 | 0.05 | 0.025 | 14 | x |

As can be seen from the results in Table 7, corrosion resistance is excellent at an Al content of not less than 4.0% but adherence is bad at over 10%. This can be viewed as being caused by abnormal development of an alloy layer (Fe—Al alloy layer).

Example 8

Regarding line-like stripe pattern on plating layer surface and suppression thereof. This example relates to a case in which a mixed gas of nitrogen gas and air was used as a wiping gas, without a sealed box.

Hot-dip Zn—Al—Mg plated steel sheet was produced under the following conditions and the steepness of the surface of the hot-dip plated steel sheet obtained was calculated in accordance with Equation (1).

{Plating conditions}

Processing equipment:

All radiant tube-type continuous hot-dip plating line

Processed steel sheet:

Hot-rolled steel strip (thickness: 1.6 mm) of medium-carbon aluminum-killed steel Maximum temperature reached by sheet in reduction furnace:

600° C.

Dew point of atmosphere in reduction furnace:

−30° C.

Plating bath temperature:

400° C.

Period of immersion:

Wiping gas:

Nitrogen gas+air (oxygen adjusted to 0.1–12 vol. %)

Post-plating cooling rate:

8° C./s by the air cooling method

Plating amount:

50, 100, 150 or 200 g/m$^2$

Plating bath composition:

Al=6.2 wt. %

Mg=3.5 wt. %

Ti=0.01 wt. %

B=0.002 wt. %

Balance=Zn

Table 8 shows for each of the plating amounts set out above the measured steepness of various plated steel sheets obtained by varying the mixing ratio of the nitrogen and air (varying the oxygen concentration) of the wiping gas. The evaluation of the line-like stripe pattern in the table rates the visually observed degree of the pattern in three levels: absolutely no pattern observed or extremely slight pattern causing no problem whatsoever regarding appearance is indicated by ○ marks, pattern observed but not so large by Δ marks, and pattern clearly observed by X marks.

TABLE 8

| Plating amount (per side) (g/m$^2$) | Oxygen concentration of wiping gas (Vol. %) | Steepness (%) | Evaluation of line-like stripe pattern |
|---|---|---|---|
| 50 | 0.1 | 0.04 | ○ |
| 50 | 1.0 | 0.05 | ○ |
| 50 | 3.0 | 0.07 | ○ |
| 50 | 5.0 | 0.08 | ○ |
| 50 | 8.0 | 0.11 | Δ |
| 50 | 12.0 | 0.13 | Δ |
| 100 | 0.1 | 0.05 | ○ |
| 100 | 1.0 | 0.06 | ○ |
| 100 | 3.0 | 0.08 | ○ |
| 100 | 5.0 | 0.11 | Δ |
| 100 | 8.0 | 0.12 | Δ |
| 100 | 12.0 | 0.18 | x |
| 150 | 0.1 | 0.05 | ○ |
| 150 | 1.0 | 0.06 | ○ |
| 150 | 3.0 | 0.09 | ○ |
| 150 | 5.0 | 0.12 | Δ |
| 150 | 8.0 | 0.14 | Δ |
| 150 | 12.0 | 0.25 | x |
| 200 | 0.1 | 0.06 | ○ |
| 200 | 1.0 | 0.08 | ○ |
| 200 | 3.0 | 0.10 | ○ |
| 200 | 5.0 | 0.12 | Δ |
| 200 | 8.0 | 0.16 | x |
| 200 | 12.0 | 0.32 | x |

As can be seen from the results in Table 8, steepness was not more than 0.1% and a plated steel sheet with no appearance problem was obtained at all plating amounts insofar as the oxygen concentration of the wiping gas was made not more than 3 vol. %. The case of a plating amount of 50 g/m$^2$ was, however, a special case in which an oxygen concentration of the wiping gas up to 5 vol. % was allowable.

Example 9

Regarding line-like stripe pattern on plating layer surface and suppression thereof. This example relates to a case in which waste gas of combustion was used as wiping gas, without a sealed box.

Hot-dip Zn—Al—Mg plated steel sheet was produced under the following conditions and the steepness of the surface of the hot-dip plated steel sheet obtained was calculated in accordance with Equation (1).

{Plating conditions}

Processing equipment:

NOF-type continuous hot-dip plating line

Processed steel sheet:

Cold-rolled steel strip (thickness: 0.8 mm) of low-carbon aluminum-killed steel

Maximum temperature reached by sheet in reduction furnace:

780° C.

Dew point of atmosphere in reduction furnace:

−25° C.

Plating bath temperature:

450° C.

Period of immersion:

3s

Wiping gas:

Waste combustion gas from nonoxidization furnace (varied in oxygen concentration)

Post-plating cooling rate:

12° C./s by the air cooling method

Plating amount:

50, 100, 150 or 200 g/m$^2$

Plating bath composition:

Al=9.1 wt. %

Mg=2.0 wt. %

Ti=0.02 wt. %

B=0.004 wt. %

Balance=Zn

Table 9 shows for each of the plating amounts set out above the measured steepness of various plated steel sheets obtained by varying the oxygen concentration of the waste combustion gas used as the wiping gas. (The oxygen concentration of the waste combustion gas was varied as denoted by combining variation of nonoxidization furnace air-fuel ratio with afterburning of the waste combustion gas.) The evaluation of line-like stripe pattern in the table is the same as that in Example 8.

Owing to the variation of the nonoxidization furnace air/fuel ratio and the variation of the waste combustion gas afterburing conditions, the carbon dioxide concentration and the steam concentration of the waste gas also varied. The variation ranges were as follows:

Oxygen concentration: 0.1–12 vol. %

Carbon dioxide concentration: 0.3–10 vol. %

Steam concentration: 1.5–5.3 vol. %

TABLE 9

| Plating amount (per side) ($g/m^2$) | Oxygen concentration of wiping gas (Vol. %) | Steepness (%) | Evaluation of line-like stripe pattern |
|---|---|---|---|
| 50 | 0.1 | 0.04 | ○ |
| 50 | 1.0 | 0.05 | ○ |
| 50 | 3.0 | 0.07 | ○ |
| 50 | 5.0 | 0.08 | ○ |
| 50 | 8.0 | 0.12 | Δ |
| 50 | 12.0 | 0.15 | Δ |
| 100 | 0.1 | 0.05 | ○ |
| 100 | 1.0 | 0.06 | ○ |
| 100 | 3.0 | 0.09 | ○ |
| 100 | 5.0 | 0.12 | Δ |
| 100 | 8.0 | 0.14 | Δ |
| 100 | 12.0 | 0.18 | x |
| 150 | 0.1 | 0.05 | ○ |
| 150 | 1.0 | 0.07 | ○ |
| 150 | 3.0 | 0.09 | ○ |
| 150 | 5.0 | 0.12 | Δ |
| 150 | 8.0 | 0.15 | Δ |
| 150 | 12.0 | 0.26 | x |
| 200 | 0.1 | 0.07 | ○ |
| 200 | 1.0 | 0.09 | ○ |
| 200 | 3.0 | 0.10 | ○ |
| 200 | 5.0 | 0.13 | Δ |
| 200 | 8.0 | 0.18 | x |
| 200 | 12.0 | 0.35 | x |

As can be seen from the results in Table 9, steepness was not more than 0.1% and a plated steel sheet with no appearance problem was obtained at all plating amounts even when waste combustion gas containing carbon dioxide and steam was used as the wiping gas, insofar as the oxygen concentration of the gas was made not more than 3 vol. %. From this it is obvious that what affects the morphology of the Mg-containing oxide film that influences the steepness is free oxygen, so that if not the oxygen in the $CO_2$ and/or the oxygen in the $H_2O$ but the free oxygen concentration is kept from exceeding 3 vol. %, the steepness can be kept to not greater than 0.1%. The case of a plating amount of 50 $g/m^2$ was, however, a special case in which an oxygen concentration of the wiping gas up to 5 vol. % was allowable.

Example 10

Regarding line-like stripe pattern on plating layer surface and suppression thereof. This example relates to a case in which a sealed box was installed and waste gas of combustion was blown from the wiping nozzles inside the sealed box.

The sealed box 6 was installed to house the wiping nozzles 5 therein as shown in FIG. 13 and the oxygen concentration of the waste combustion gas blown from the wiping gas nozzles 5 was varied as in the case of Example 9. It was confirmed by gas analysis measurement that the oxygen concentration of the wiping gas and the oxygen concentration of sealed box have a very close correlation. It can therefore be assumed that during operation the interior of the sealed box is maintained at a gas atmosphere of the same composition as the wiping gas.

The plating conditions and bath composition were made substantially the same as in the case of Example 9 and the steepness was measured at each plating amount for plated steel sheets obtained by varying the oxygen concentration of the wiping gas. The results of Table 10 were obtained. In Table 10, "Oxygen concentration in sealed box" is shown as the measured value of the oxygen concentration of the wiping gas. Owing to the variation of the nonoxidization furnace air/fuel ratio and waste combustion gas afterburing conditions, the carbon dioxide concentration and the steam concentration of the waste gas also varied. The variation ranges were the same as those in the case of Example 9.

TABLE 10

| Plating amount (per side) ($g/m^2$) | Oxygen concentration of wiping gas (Vol. %) | Steepness (%) | Evaluation of line-like stripe pattern |
|---|---|---|---|
| 50 | 0.1 | 0.03 | ○ |
| 50 | 1.0 | 0.04 | ○ |
| 50 | 3.0 | 0.04 | ○ |
| 50 | 5.0 | 0.06 | ○ |
| 50 | 8.0 | 0.07 | ○ |
| 50 | 12.0 | 0.11 | Δ |
| 100 | 0.1 | 0.04 | ○ |
| 100 | 1.0 | 0.04 | ○ |
| 100 | 3.0 | 0.06 | ○ |
| 100 | 5.0 | 0.06 | ○ |
| 100 | 8.0 | 0.08 | ○ |
| 100 | 12.0 | 0.12 | Δ |
| 150 | 0.1 | 0.05 | ○ |
| 150 | 1.0 | 0.05 | ○ |
| 150 | 3.0 | 0.06 | ○ |
| 150 | 5.0 | 0.07 | ○ |
| 150 | 8.0 | 0.09 | ○ |
| 150 | 12.0 | 0.14 | Δ |
| 200 | 0.1 | 0.05 | ○ |
| 200 | 1.0 | 0.06 | ○ |
| 200 | 3.0 | 0.06 | ○ |
| 200 | 5.0 | 0.08 | ○ |
| 200 | 8.0 | 0.10 | ○ |
| 200 | 12.0 | 0.15 | Δ |

As can be seen from the results in Table 10, steepness was not more than 0.1 and a plated steel sheet with no appearance problem was obtained at all plating amounts even when waste combustion gas containing carbon dioxide and steam was used as the wiping gas, insofar as the oxygen concentration of the wiping gas and, accordingly, the oxygen concentration in the sealed box was made not more than 8 vol. %. From this it is obvious that what affects the morphology of the Mg-containing oxide film that influences the steepness is free oxygen, so that if not the oxygen in the $CO_2$ and/or the oxygen in the $H_2O$ but the free oxygen concentration is kept from exceeding 3 vol. %, the steepness can be kept to not greater than 0.1.

Example 11

This Example is a steepness measurement example. Although the steepness measurements of Tables 8–10 were conducted as explained in the text, an actual measurement example will be set out in the following.

Figure 14:
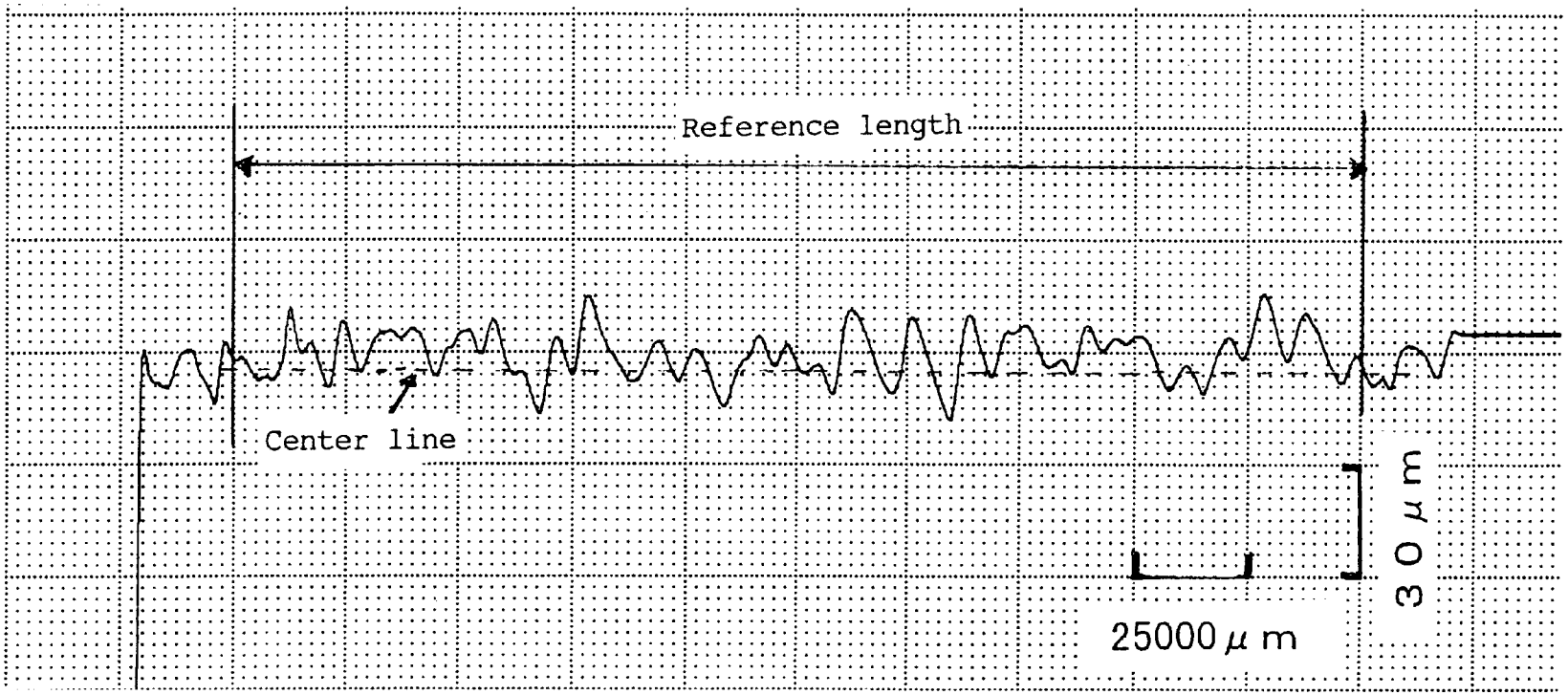
FIG. 14 is a chart showing an example of an undulating curve obtained for the surface of a hot-dip Zn—Al—Mg plated steel sheet.

FIG. 14 shows an example of a measured undulating curve of a plated steel sheet surface. The measurement for this chart was made in the direction of sheet passage (lengthwise direction of the steel strip) with a tracer type surface roughness shape measuring instrument. The reference length (L) was taken as $250\times10^3$ μm (250 mm).

A center line was drawn through the undulating curve, and

Height of each mountain to the center line=$m_1$

Number of mountains within L=Nm

Depth of each valley to the center line=$V_1$

Number of valleys within L=Vm were obtained. From these were calculated

Average mountain height $M=\Sigma m_1/Nm$

Average valley depth $V=\Sigma V_1/Vm$

Average pitch=L/Nm.

From these was calculated the Average elevation differential=M+V. The Average elevation differential was divided by the Average pitch and the result was represented as % to obtain the Steepness. When simplified, this operation becomes: Steepness (%)=100×Nm×(M+V)/L.

Taking a specific instance, in the case of the plated steel sheet of Table 8 obtained with a plating amount=150 g/m$^2$ and wiping gas oxygen concentration=5.0 vol. %:

At $L=250\times10^3$ μm, $\Sigma m_1=172$ μm,

Nm=25, $EV_1=137$ μm,

Vm=25 was calculated,

Average elevation differential (M+V)=12.4 μm,

And average pitch=$10\times10^3$ μm.

Hence, Steepness=0.12% was calculated.

Figure 15:
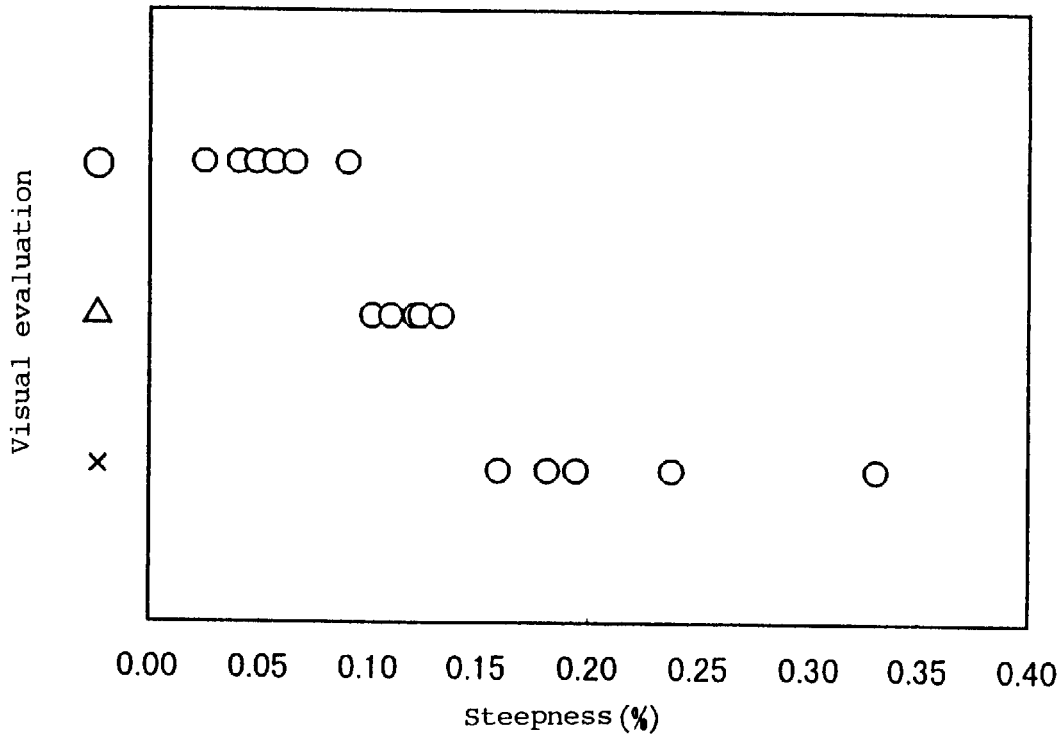
FIG. 15 shows a data table and a graph indicating the relationship between the steepness and the visual stripe pattern evaluation of the hot-dip Zn—Al—Mg plated steel sheet.

FIG. 15 shows the correlation between the steepness determined in the foregoing manner and the visual evaluation of the line-like stripe pattern. At the top of FIG. 15 is shown the relationship between the value of the steepness (and also the average elevation differential and the average pitch) and the visual evaluation explained in Example 8. This is illustrated graphically at the bottom of FIG. 15. From FIG. 15 it can be seen that a plated steel sheet with a steepness of not greater than 0.10% is an industrial product with no line-like stripe pattern.

Example 12

Regarding line-like stripe pattern on plating layer surface and suppression thereof. This example shows the relationship between amount of Be addition and the stripe pattern.

Figure 16:
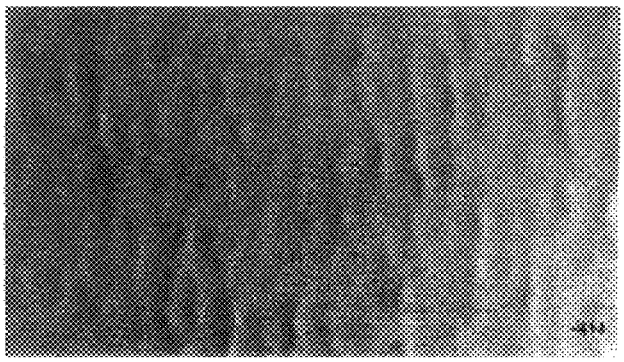
FIG. 16 shows a typical example of a standard for evaluating the stripe pattern appearing on the surface of a hot-dip Zn—Al—Mg plated steel sheet, the stripe pattern decreasing in order from (a) to (d).
Figure 16:
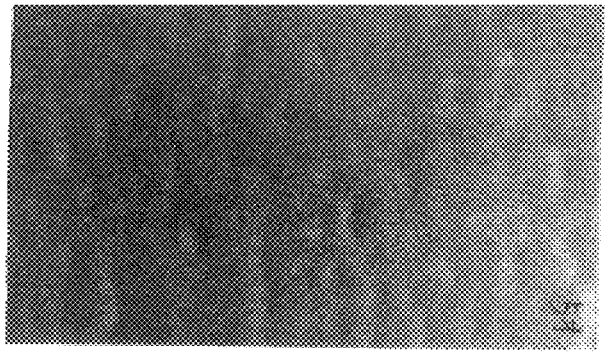
Figure 16:
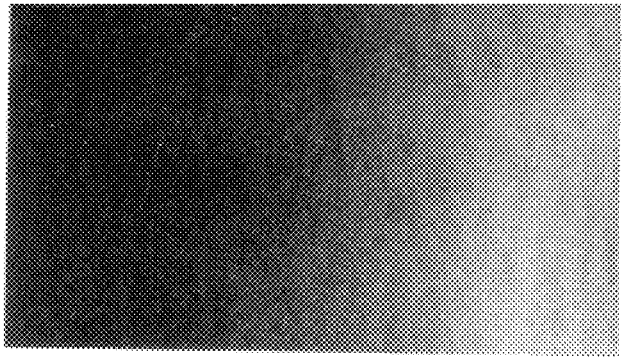
Figure 16:
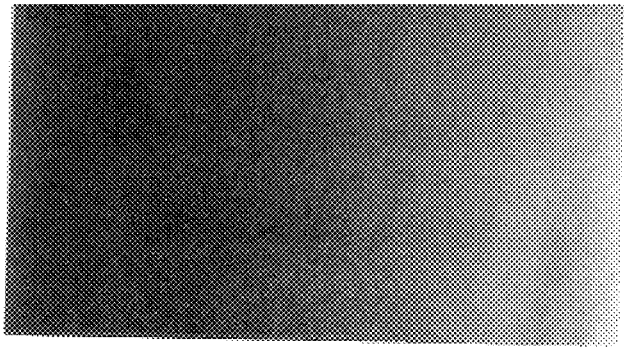

Hot-dip Zn—Al—Mg plated steel sheet was produced under the following conditions and the degree of the stripe pattern that appeared on the surface of the hot-dip Zn—Al—Mg plated steel sheet obtained was visually rated in four levels. The evaluation standard was as follows:

Strong stripe pattern (typical example shown in FIG. 16, photograph (a)) . . . Denoted by X marks Medium stripe pattern (typical example shown in FIG. 16, photograph (b)) . . . Denoted by Δ marks Weak stripe pattern (typical example shown in FIG. 16, photograph (c)) . . . Denoted by ○ marks No stripe pattern (typical example shown in FIG. 16, photograph (d)) . . . Denoted by ⊙ marks The photographs of 16(a)–(d) are all reduced 65% relative to the actual articles (6.5 mm in the photographs is actually 10 mm) and were photographed with the illumination directed at right angles to the line-like stripe patterns (plating direction=lengthwise direction of the steel strips) so that the stripe patterns would photograph well.

{Plating conditions}

Processing equipment:

Continuous hot-dip plating simulator

Processed steel sheet:

Weakly killed steel sheet (thickness: 0.8 mm)

Pass velocity:

50 m/min.

Plating bath temperature:

400° C.

Period of immersion:

3s

Wiping gas:

Oxygen concentration of 5 vol. %, balance of nitrogen and nitrogen-system gases

Wiping nozzle position:

100 mm above bath

Plating bath composition:

Al=5.8 wt. %

Mg=3.1 wt. %

Be=0, 0.0006, 0.001, 0.015 or 0.05 wt. %

Balance=Zn

With respect to each of the plating baths varied in Be content as shown in FIG. 11, the plating amount was controlled by regulating the pressure of the jetted wiping gas. The stripe patterns appearing on the plated steel sheets are rated under Surface appearance evaluation in Table 11.

TABLE 11

| No | Plating amount per side (g/m$^2$) | Be content (wt. %) | Surface appearance evaluation |
|---|---|---|---|
| 1 | 50 | 0 | ○ |
| 2 | 50 | 0.0006 | ○ |
| 3 | 50 | 0.001 | ⊙ |
| 4 | 50 | 0.015 | ⊙ |
| 5 | 50 | 0.05 | ⊙ |
| 6 | 100 | 0 | Δ |
| 7 | 100 | 0.0006 | Δ |
| 8 | 100 | 0.001 | ⊙ |
| 9 | 100 | 0.015 | ⊙ |
| 10 | 100 | 0.05 | ⊙ |
| 11 | 150 | 0 | x |
| 12 | 150 | 0.0006 | x |
| 13 | 150 | 0.001 | ⊙ |
| 14 | 150 | 0.015 | ⊙ |
| 15 | 150 | 0.05 | ⊙ |
| 16 | 200 | 0 | x |
| 17 | 200 | 0.0006 | x |
| 18 | 200 | 0.001 | ○ |
| 19 | 200 | 0.015 | ⊙ |
| 20 | 200 | 0.05 | ⊙ |

As can be seen from the results in Table 11, the greater was the plating amount, the more the stripe pattern stood out. At every plating amount, however, the stripe pattern was decreased by Be addition. It can be seen that this effect appears at a Be content of around 0.001 wt. % and that evaluation rank rises with increasing Be addition but the effect substantially saturates at about 0.05 wt. %.

Example 12 was repeated except that the plating bath composition was changed to the following (1)–(7). The result was that exactly the same surface appearance evaluations as in Table 11 were obtained for all of the bath compositions.

(1) Al=5.8 wt. %

Mg=1.5 wt. %

Be=0, 0.0006, 0.001, 0.015 or 0.05 wt. %

Balance=Zn (2) Al=9.5 wt. %

Mg=3.6 wt. %

Be=0, 0.0006, 0.001, 0.015 or 0.05 wt. %

Balance=Zn (3) Al=9.5 wt. %

Mg=1.2 wt. %

Be=0, 0.0006, 0.001, 0.015 or 0.05 wt. %

Balance=Zn (4) Al=5.8 wt. %

Mg=3.1 wt. %

Ti=0.03 wt. %

B=0.006 wt. %

Be=0.0006, 0.001, 0.015 or 0.05 wt. %

Balance=Zn (5) Al=5.8 wt. %

Mg=1.5 wt. %

Ti=0.03 wt. %

B=0.006 wt. %

Be=0, 0.0006, 0.001, 0.015 or 0.05 wt. %

Balance=Zn (6) Al=9.5 wt. %

Mg=3.6 wt. %

Ti=0.01 wt. %

B=0.002 wt. %

Be=0, 0.0006, 0.001, 0.015 or 0.05 wt. %

Balance=Zn (7) Al=9.5 wt. %

Mg=1.2 wt. %

Ti=0.01 wt. %

B=0.002 wt. %

Be=0, 0.0006, 0.001, 0.015 or 0.05 wt. %

Balance=Zn

Example 13

Example 12 was repeated except that the plating conditions were changed as follows. The stripe patterns appearing on the plated steel sheets were evaluated by the same method as in Example 12. The results are shown in Table 12.

{Plating conditions}

Processing equipment:

Continuous hot-dip plating simulator

Processed steel sheet:

Weakly killed steel sheet (thickness: 0.5 mm)

Pass velocity:

100 m/min.

Plating bath temperature:

420° C.

Period of immersion:

2s

Wiping gas:

Air

Wiping nozzle position:

150 mm above bath

Plating bath composition:

Al=6.5 wt. %

Mg=1.1 wt. %

Be=0, 0.0006, 0.001, 0.015 or 0.05. wt. %

Balance=Zn

TABLE 12

| No | Plating amount per side ($g/m^2$) | Be content (wt. %) | Surface appearance evaluation |
|---|---|---|---|
| 1 | 50 | 0 | ○ |
| 2 | 50 | 0.0006 | ○ |
| 3 | 50 | 0.001 | ◎ |
| 4 | 50 | 0.015 | ◎ |
| 5 | 50 | 0.05 | ◎ |
| 6 | 100 | 0 | x |
| 7 | 100 | 0.0006 | Δ |
| 8 | 100 | 0.001 | ◎ |
| 9 | 100 | 0.015 | ◎ |
| 10 | 100 | 0.05 | ◎ |
| 11 | 150 | 0 | x |
| 12 | 150 | 0.0006 | x |
| 13 | 150 | 0.001 | ○ |
| 14 | 150 | 0.015 | ◎ |
| 15 | 150 | 0.05 | ◎ |
| 16 | 200 | 0 | x |
| 17 | 200 | 0.0006 | x |
| 18 | 200 | 0.001 | ○ |
| 19 | 200 | 0.015 | ◎ |
| 20 | 200 | 0.05 | ◎ |

As can be seen from the results in Table 12, the greater was the plating amount, the more the stripe pattern stood out. At every plating amount, however, the stripe pattern was decreased by Be addition. It can be seen that this effect appears at a Be content of around 0.001 wt. %.

Example 13 was repeated except that the plating bath composition was changed to the following (1)–(3). The result was that exactly the same surface appearance evaluations as in Table 12 were obtained for all of the bath compositions.

(1) Al=6.5 wt. %

Mg=2.6 wt. %

Be=0, 0.0006, 0.001, 0.015 or 0.05 wt. %

Balance=Zn (2) Al=6.5 wt. %

Mg=2.6 wt. %

Ti=0.02 wt. %

B=0.004 wt. %

Be=0.0006, 0.001, 0.015 or 0.05 wt. %

Balance=Zn (3) Al=6.5 wt. %

Mg=1.1 wt. %

Ti=0.02 wt. %

B=0.004 wt. %

Be=0, 0.0006, 0.001, 0.015 or 0.05 wt. %

Balance=Zn

Example 14

This example shows the corrosion resistance of plated steel sheets using a Be-added bath.

Hot-dip Zn—Al—Mg plated steel sheet was produced under the following conditions. The corrosion resistance of the hot-dip plated steel sheet was examined. Corrosion resistance was evaluated based on corrosion loss ($g/m^2$) after conducting SST (saltwater spray test according to JIS-Z-2371) for 800 hours. The results are shown in Table 13.

{Plating conditions}

Processing equipment:

Continuous hot-dip plating simulator

Processed steel sheet:

Weakly killed steel sheet (thickness: 0.8 mm)

Pass velocity:

70 m/min.

Plating bath temperature:

400° C.

Period of immersion:

3s

Wiping gas:

5 vol. %$O_2$+Balance of $N_2$

Wiping nozzle position:

100 mm above bath

Plating amount per side:

150 g/$m^2$

Plating bath composition:

Al=6.2 wt. %

Mg=2.8 wt. %

Ti=0.01 wt. %

B=0.002 wt. %

Be=0, 0.001, 0.02, 0.04, 0.06 or 0.08 wt. %

Balance=Zn

TABLE 13

| No | Be content (wt. %) | Corrosion loss |
|---|---|---|
| 1 | 0 | 17 |
| 2 | 0.001 | 17 |
| 3 | 0.02 | 17 |
| 4 | 0.04 | 18 |
| 5 | 0.06 | 25 |
| 6 | 0.08 | 28 |

As can be seen from Table 13, addition of Be up to 0.05 wt. % has no effect on corrosion resistance.

As explained in the foregoing, the present invention provides a hot-dip Zn—Al—Mg plated steel sheet excellent in corrosion resistance and surface appearance and an advantageous method of producing the same. Owing to this excellent corrosion resistance, the invention enables expansion into new fields of application not achievable by conventional hot-dip Zn-base plated steel sheet.

What is claimed is:

1. A hot-dip Zn—Al—Mg-system plated steel sheet good in corrosion resistance and surface appearance that is a hot-dip Zn-base plated steel sheet obtained by forming on a surface of a steel sheet a plating layer composed of Al: 4.0–10 wt. %, Mg: 1.0–4.0 wt. %, Ti: 0.002–0.1 wt. %, B: 0.001–0.045 wt. % and the balance of Zn and unavoidable impurities, the plating layer having a metallic structure including a primary crystal Al phase in a matrix of Al/Zn/$Zn_2$Mg ternary eutectic structure.

2. A hot-dip Zn—Al—Mg-system plated steel sheet good in corrosion resistance and surface appearance that is a hot-dip Zn-base plated steel sheet obtained by forming on a surface of a steel sheet a plating layer composed of Al: 4.0–10 wt. %, Mg: 1.0–4.0 wt. %, Ti: 0.002–0.1 wt. %, B: 0.001–0.045 wt. % and the balance of Zn and unavoidable impurities, the plating layer having a metallic structure including a primary crystal Al phase and a Zn single phase in a matrix of Al/Zn/$Zn_2$Mg ternary eutectic structure.

3. A hot-dip Zn—Al—Mg plated steel sheet according to claim 1, wherein the metallic structure of the plating layer is composed of a total amount of the primary crystal Al phase and the Al/Zn/$Zn_2$Mg ternary eutectic structure: not less than 80 vol. %, and Zn single phase: not greater than 15 vol. %, including 0 vol. %.

4. A method of producing hot-dip Zn—Al—Mg plated steel sheet good in corrosion resistance and surface appearance that is a method of producing a hot-dip Zn—Al—Mg plated steel sheet using a hot-dip plating bath composed of Al: 4.0–10 wt. %, Mg: 1.0–4.0 wt. %, Ti: 0.002–0.1 wt. %, B: 0.001–0.045 wt. % and the balance of Zn and unavoidable impurities, characterized in controlling a bath temperature of the plating bath to not lower than the melting point and lower than 410° C. and a post-plating cooling rate to not less than 7° C./s.

5. A method of producing hot-dip Zn—Al—Mg plated steel sheet good in corrosion resistance and surface appearance that is a method of producing a hot-dip Zn—Al—Mg plated steel sheet using a hot-dip plating bath composed of Al: 4.0–10 wt. %, Mg: 1.0–4.0 wt. %, Ti: 0.002–0.1 wt. %, B: 0.001–0.045 wt. % and the balance of Zn and unavoidable impurities, characterized in controlling a bath temperature of the plating bath to not lower than 410° C. and a post-plating cooling rate to not less than 0.5° C./s.

6. A method of producing hot-dip Zn—Al—Mg plated steel sheet according to claim 4, wherein the plating layer of the plated steel sheet has a metallic structure including a primary crystal Al phase or a primary crystal Al phase and a Zn single phase in a matrix of Al/Zn/$Zn_2$Mg ternary eutectic structure.

7. A Mg-containing hot-dip Zn-base plated steel sheet formed with a plated surface whose steepness is not more than 0.1% by, during continuous extraction of a steel strip from a hot-dip plating bath in which it is continuously immersed, which bath is composed of Al: 4.0–10 wt. % and Mg: 1.0–4.0 wt. %, and, as required, Ti: 0.002–0.1 wt. % and B: 0.001–0.045 wt. %, and the balance of Zn and unavoidable impurities, controlling a morphology of a Mg oxide-containing coating forming on a surface of a plating layer up to solidification of the surface layer, provided that the steepness (%) is a value calculated by Equation (1) from an undulating shape curve of a unit length of a measured undulating shape of the plating surface in a sheet passage direction (lengthwise direction of the strip)

$$\text{Steepness } (\%)=100\times Nm\times(M+V)/L \quad (1),$$

where:

L=Unit length (set to a value not less than $100\times10^3$ μm such as $250\times10^3$ μm), Nm=Number of mountains within unit length, M=Average mountain height within unit length (μm), V=Average valley depth within unit length (μm).

* * * * *